US007062211B2

(12) United States Patent
Baba et al.

(10) Patent No.: US 7,062,211 B2
(45) Date of Patent: Jun. 13, 2006

(54) PEELING DEVICE AND FIXING DEVICE AND IMAGE FORMING APPARATUS USING THE PEELING DEVICE

(75) Inventors: Motofumi Baba, Nakai-machi (JP); Yasuhiro Uehara, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 209 days.

(21) Appl. No.: 10/706,009

(22) Filed: Nov. 13, 2003

(65) Prior Publication Data

US 2004/0120735 A1 Jun. 24, 2004

(30) Foreign Application Priority Data

Dec. 19, 2002 (JP) ..... 2002-368102
Nov. 5, 2003 (JP) ..... 2003-375435

(51) Int. Cl.
*G03G 15/20* (2006.01)

(52) U.S. Cl. ..... 399/323

(58) Field of Classification Search ..... 399/323, 399/398, 399
See application file for complete search history.

(56) References Cited

U.S. PATENT DOCUMENTS 3,955,813 A * 5/1976 Edwards ..... 399/323
5,406,363 A * 4/1995 Siegel et al. ..... 399/323
6,243,556 B1 * 6/2001 Shin ..... 399/323
6,564,030 B1 * 5/2003 Baughman et al. ..... 399/323
6,810,229 B1 * 10/2004 Coleman et al. ..... 399/323

FOREIGN PATENT DOCUMENTS

JP A 59-188681 10/1984
JP A 61-59468 3/1986
JP A 2000-250351 9/2000
JP B2 3322095 6/2002

* cited by examiner

*Primary Examiner*—William J. Royer
(74) *Attorney, Agent, or Firm*—Oliff & Berridge, PLC

(57) ABSTRACT

A peeling device for peeling off a sheet-like recording medium that is conveyed while adhering to a surface of a rotating member that rotates, from the rotating member, includes a peeling guide plate one side of which is close to a surface of the rotating member in a region where the surface of the rotating member advances while curving in the rotating direction, or on a downstream side of the region and which is disposed in a rotating direction of the rotating member, and an edge surface of the peeling guide plate including at least one convex portion. An air jetting unit jets a pulsed compressed air toward a gap between the surface of the rotating member and the one side of the peeling guide plate that is from a region interposed between the surface of the rotating member and the surface of the peeling guide plate that faces the surface of the rotating member.

10 Claims, 13 Drawing Sheets

PEELING DEVICE AND FIXING DEVICE AND IMAGE FORMING APPARATUS USING THE PEELING DEVICE

FIELD OF THE INVENTION AND RELATED ART STATEMENT

The present invention relates to an image recording apparatus, and more particularly to a peeling device which is applicable in a fixing device or a transferring and simultaneous fixing device for use in an image recording apparatus of an electrophotographic process such as an electronic copying machine or a facsimile machine, and a fixing device and an image forming apparatus using the peeling device.

Up to now, in an image recording apparatus of the electrophotographic process such as an electronic copying machine or a facsimile machine, as a fixing device that fixes a toner image that has been transferred to the surface of a sheet, there has been widely employed a fixing device (fixing device of a two-roll system) in which the sheet onto which the toner image has been transferred is allowed to pass through a nip portion formed by a pair of rolls composed of a fixing roll and a pressure roll, and the toner image is fused to the sheet by means of a heat generated by the fixing roll and a pressure applied with the pair of rolls.

In the above fixing process, since the toner image that has been fused to the sheet comes into contact with the fixing roll, for example, a roll whose surface has been coated with a fluorine resin having a high releasing property is used as the fixing roll. However, even if the fixing roll of this type is used, because the melted toner is soft and high in viscosity, there is a fear that the melted toner is liable to adhere to the surface of the fixing roll, and the sheet is wound around the fixing roll. Under the above circumstances, there have been generally applied a forced peeling device using a peeling claw shown in FIG. 1 of JP 59-188681 A or a peeling sheet (plastic sheet) made of plastic shown in FIG. 2 of the same publication, and a method of providing the above peeling sheet in an on-contact manner to peel off the sheet, thereby preventing the winding of the sheet around the fixing roll.

However, in the above fixing device having the peeling claw and the peeling sheet, for example, in the case where a thickness of the toner image portion immediately after the fixing is relatively small, and the viscosity thereof is high, the sheet can be peeled off without any problems. However, in the case where the toner image has a large amount of toner, or the thickness of the toner image portion immediately after the fixing is relatively large, and the toner image is heated at a high temperature by the fixing roll so that an adhesion becomes large as in the case of forming a color image, a large amount of toner is adhered to a fluorine resin layer on the fixing roll surface, an excessive peeling force acts on peeling members such as the peeling claw or peeling sheet. In this case, because the sheet with the toner image immediately after the sheet has passed through the nip portion is conveyed while being rubbed against a guide portion of the peeling member, the toner image is damaged by the peeling member, thereby easily causing an image defect. In particular, in the case where the color image is fixed, since the toner image of a sufficiently developed color is required, the toner must be sufficiently heated and melted. Accordingly, since the toner immediately after the sheet has passed through the nip portion becomes low in viscosity, the image defect is more likely to occur.

Under such circumstances, a self-stripping method is often adopted for solving the above problems. The self-stripping method is a peeling method with which the sheet is naturally peeled off from the fixing roll by means of a rigidity of the sheet and an elasticity of the fixing roll instead of using any forced peeling device using peeling claws, a peeling sheet, or the like. As a method of implementing this self-stripping method, in the case of fixing a color image, there is widely adopted a method normally in which a fixing roll having an elastic layer made of silicone rubber having higher releasing property than fluorine resin, formed on a surface of a roll core is used, and in which a relatively large quantity (10 mg or more/A4-size sheet) of oil is always supplied to the surface of the elastic layer. (For example, refer to JP 3322095 B).

However, a conventional fixing device which achieves self-stripping has the following various problems:

(1) A reliability of the fixing roll may be reduced by various causes such as wearing of the elastic layer made of silicone rubber on the surface of the fixing roll, deterioration of the releasing property, or the elastic layer deterioration caused by oil permeated into the fixing roll.

(2) It is inferior in maintainability because oil must be periodically replenished, and there is some possibility that an oil supply system generates the trouble which is the defect of a fixed toner image on a medium due to over and uneven oiling onto a fixing device, consequently the trouble lowers the reliability of the fixing device.

(3) Oil easily remains on a sheet surface after the fixing, which easily deteriorates a touch-up ability with a ball-point pen or ink.

In addition, in recent years, there increase an opportunity that a coated paper small in basis weight is employed, and an opportunity that an image such as a photographic image which requires a large amount of toner is outputted from a leading end of the sheet in a state where a leading margin portion of the sheet is smaller than that in the conventional art. There is required a peeling technique that ensures the sheet peeling even under the above circumstances.

Incidentally, there is a technique that uses a compressed air for the sheet peeling. Specifically, as disclosed in, for example, JP 2000-250351 A, there is a structure in which the compressed air is supplied from an air passage disposed within the peeling claw in correspondence with the leading end position of a print paper. The above publication discloses that since the compressed air is blown to the leading end position of the print paper to peel off the leading end of the print paper, it is possible to remarkably improve a deterioration of the peeling layer on the surface of the fixing roll which results from abutment of the peeling claw against the surface of the fixing roll, or a deterioration of an image quality which results from a damage of the toner image on the print paper by the peeling claw. However, this technique is made under the conditions that plural notched grooves are defined at positions of a heat roll fixing surface (fixing roll surface) corresponding to the peeling claws, and therefore, since a flatness of the fixing roll surface cannot be ensured, a texture of a fixed image is adversely affected. Moreover, the amount of compressed air required to peel off the sheet is enormous, resulting in a large-sized device and high costs. In addition, there is a fear about a drawback caused by a convection of the supplied compressed air within the device, for example, toner scattering, to thereby make it difficult to put this technique in practical use.

There are other techniques that use the compressed air for the sheet peeling. However, in all of those techniques, the notched grooves are not formed on the surface of the fixing roll, and for that reason, a larger amount of compressed air is required for the sheet peeling, to thereby make it more difficult to put this technique in practical use (for example, refer to JP 61-59468 A) as compared with the above-mentioned technique.

The above-mentioned problem on the sheet peeling is not limited to the fixing device of the two-roll system but basically remains to be solved in a fixing device of a roll-belt nip method and a fixing device of a belt-belt nip method, likewise. In addition, the above-mentioned problem arises to some degree in image transfer in various printing systems including electrostatic transfer in the electrophotographic process and in peeling off a transfer member (photosensitive member, printing plate, or the like) from a recording medium (sheet or the like). Similarly, the above-mentioned problem occurs in a case where the recording medium is in close contact with some rotating member (roll, belt, or the like) by some action (for example, electrostatic action), and it is necessary to peel off them from each other. Accordingly, the peeling device that can solve the above-mentioned problems is demanded in various portions in the image forming field.

SUMMARY OF THE INVENTION

The present invention has been made in view of the above circumstances, and provides a peeling device that can perform a stable peeling operation even with a recording medium that makes peeling difficult to achieve (for example, the medium is oilless, an amount of toner in a toner image is large, the toner image exists up to a leading end of the recording medium, a basis weight of the recording medium is small, the recording medium is a thin coated paper, or the like) without damaging an image, the recording medium and a rotating member including a fixing roll, and a fixing device and an image forming apparatus having the peeling device. In particular, the present invention provides a peeling device that achieves the above by applying a technique using a compressed air for sheet peeling and is of practical use without adversely affecting an image quality, and a fixing device and an image forming apparatus having the peeling device.

The above-mentioned object is achieved according to an aspect or another aspect of the present invention described below.

First, according to an aspect of the present invention, there is provided a peeling device for peeling off a sheet-like recording medium that is conveyed while adhering to the surface of a rotating member that rotates, from the rotating member, including:

a peeling guide plate one side of which is close to a surface of the rotating member in a region where the surface of the rotating member advances while curving in the rotating direction, or on a downstream side of the region and which is disposed (in a laid state) in a rotating direction of the rotating member; and an air jetting unit that jets a pulsed compressed air toward a gap between the surface of the rotating member and the one side of the peeling guide plate that is close to the surface of the rotating member from a region interposed between the surface of the rotating member and the surface of the peeling guide plate that faces the surface of the rotating member.

In the peeling device according to the present invention, first, in the region where the surface of the rotating member advances while curving in the rotating direction or on the downstream side of the region, the recording medium conveyed while adhering to the surface of the rotating member is applied with a force that acts to peel off the recording member from the surface of the rotating member due to a rigidity of the recording medium per se in accordance with the rotation of the rotating member. However, in the case of the recording medium that makes peeling difficult to achieve as described above (for example, the amount of toner in the toner image is large, the toner image exists up to the leading end of the recording medium, the basis weight of the toner image is small, the recording medium is the thin coated paper, or the like), a peeling force is weak, and peeling property is not sufficient.

Up to now, in order to supplement the peeling force, the abutment against peeling claw or the peeling sheet has been performed in the above region, or the like, or the self-stripping method has been applied. However, the above cannot be sufficiently satisfied because the rotating member or the recording medium is damaged, the image quality is adversely affected, or the peeling property is not sufficient. Under the circumstances, in the peeling device according to the present invention, a technique that uses the compressed air for sheet peeling is applied to suppress an adverse influence on the image quality. That is, because when the peeling guide plate is apart from the surface of the rotating member, there is no fear that the rotating member is damaged, and because the recording member is not mechanically and forcedly peeled off from the rotating member, the recording medium is not also damaged. Similarly, at this time, because the image is in surface contact with the peeling guide plate even after peeling without damaging the image, the image quality is not deteriorated.

In addition, because the compressed air is jetted toward a gap between the surface of the rotating member and the one side of the peeling guide plate that is close to the rotating member from a region interposed between the surface of the rotating member and the surface of the peeling guide plate that faces the surface of the rotating member, the jetted compressed air takes a curtain shape through the slit-like gap, advances so as to go around the curved surface of the rotating member, and abuts against the leading end of the recording medium in the conveying direction. In this situation, because a jetted compressed air flow is adjusted at the gap and then abutted against appropriate portions of the recording medium in a spread state, an application efficiency of the compressed air is extremely high. For that reason, the jetting of the compressed air does not need to be made continuous but can be made pulsed, with the result that a total amount of compressed air can be extremely reduced. Accordingly, there is no fear that the device is large-sized and the costs are high, and there is almost no fear that the supplied compressed air is subjected to convection within the device. Thus, the structure of the peeling device according to the present invention is extremely superior in terms of practical use.

In the peeling device according to the present invention, preferably, the compressed air is jetted by the air jetting unit so that the compressed air is blown to the leading end when the leading end of the recording medium in a conveying direction which is conveyed in accordance with a rotation of the rotating member is close to a position at which the peeling guide plate is disposed. At this time, the peeling device is preferably structured such that the air jetting unit is controlled so as to jet only the compressed air in an amount sufficient for the leading end of the recording medium in the conveying direction which is peeled off from the surface of the rotating member due to the compressed air to run onto the one side of the peeling guide plate which is close to the surface of the rotating member, and a portion subsequent to the leading end of the recording medium in the conveying direction successively runs on the one side of the peeling guide plate which is close to the surface of the rotating member while the recording medium is conveyed in accordance with the rotation of the rotating member, and the surface of the recording medium is rubbed and moved on a rear side of the surface of the peeling guide plate which faces the surface of the rotating member so that the recording medium is successively peeled off from the surface of the rotating member, and an entire surface of the recording medium is finally peeled off from the recording medium.

In the peeling device according to the present invention, the air jetting unit may have a nozzle that jets the compressed air, disposed in the region interposed between the surface of the rotating member and the surface of the peeling guide plate that faces the rotating member. Further, the plural nozzles may be disposed in a direction perpendicular to the rotating direction of the rotating member.

On the other hand, according to another aspect of the present invention, there is provided a peeling device for peeling off a sheet-like recording medium that is conveyed while adhering to a surface of a rotating member that rotates, from the rotating member, including:

a peeling guide plate one side of which is close to a surface of the rotating member in a region where the surface of the rotating member advances while curving in the rotating direction, or on a downstream side of the region and which is disposed (in a laid state) in a rotating direction of the rotating member, in which the one side of the peeling guide plate which is close to the surface of the rotating member has at least one portion projecting toward the surface of the rotating member.

As described above, in the region where the surface of the rotating member advances while curving in the rotating direction or on the downstream side of the region, the recording medium is applied with a force that acts to peel off the recording member from the surface of the rotating member. However, in the case of the recording medium that is difficult to peel off, the peeling property is not sufficient. For that reason, there may occur a state in which the recording medium is partially peeled off from the surface of the rotating member due to the rigidity of the recording medium per se, and the remaining portion of the recording medium is not peeled off from the surface of the rotating member. In this case, when the one side of the peeling guide plate which is close to the surface of the rotating member is linear and arranged apart from the surface of the rotating member in parallel (at regular intervals), a portion of the recording medium which is peeled off from the surface of the rotating member advances to a rear side of the surface of the peeling guide plate which faces the surface of the rotating member, and the remaining portion of the recording medium which is not peeled off advances to the surface of the peeling guide plate which faces the surface of the rotating member because the remaining portion follows the rotation of the surface of the rotating member. That is, the portions of the recording medium which advance to both surfaces of the peeling guide plate occur at the leading end of the recording medium, and the leading end of the recording medium collides with the one side of the peeling guide plate which is close to the surface of the rotating member, with the result that not only the recording medium cannot be peeled off from the rotating member, but also a conveyance failure such as jamming occurs.

In the peeling device according to the present invention, the one side of the peeling guide plate which is close to the surface of the rotating member includes at least one portion that projects toward the surface of the rotating member. The one side of the peeling guide plate which is close to the surface of the rotating member is provided with a convex portion, in other words, a retreat portion is provided on the one side. As a result, it is assumed that at least a part of the portion that is peeled off from the surface of the rotating member in the recording medium runs on the convex portion of the peeling guide plate, and the portion that is not peeled off is peeled off together with the peeled portion that runs on the convex portion of the peeling guide plate without catching on the retreat portion of the peeling guide plate with the conveyance in accordance with the rotation of the rotating member. With this operation, the entire recording medium is excellently peeled off. Similarly to the peeling device according to the present invention, in the peeling device according to the present invention, because the peeling guide plate is apart from the surface of the rotating member and the recording medium is not mechanically and forcedly peeled off, the recording medium is peeled off without damaging the rotating member, the recording medium and the image, and because the image comes in surface contact with the peeling guide plate after peeling, the image quality is not deteriorated.

Since the action of the peeling device according to the present invention occurs only when the portion of the leading end of the recording medium which is not peeled off from the surface of the rotating member corresponds to the retreat portion of the peeling guide plate, whether or not the effect of the peeling device according to the present invention is obtained is based on the theory of probability. However the convex portion on the above-mentioned one side is provided, the probability that the effect of the peeling device according to the present invention is obtained becomes higher than that in the case where no convex portion is provided. Accordingly, the sufficiently high peeling property can be readily ensured only by the structure of the peeling device according to the present invention depending on a difficulty level of the peeling.

Also, for example, in the peeling operation at the fixing time, because the toner image is not formed on both end portions of the leading end of the recording medium in the conveying direction, an appropriate portion is caused to project, for example, only both the end portions project in accordance with the environments where the peeling device is located, the application state, and a state where the recording medium and the rotating member adhere to each other, thereby enabling the remarkably improved peeling property.

It is preferable that the peeling device according to the present invention is applied to the peeling device according to the present invention. In this case, a positional relationship between the air jetting unit of the above peeling device according to the present invention and the convex portion of the peeling device according to the present invention is appropriately adjusted, thereby enabling remarkably improved effect of the peeling property and appropriately suppressing the required amount of compressed air.

The peeling device includes all the structures of the peeling device according to the present invention, in which the air jetting unit has a nozzle (one or plural nozzles in a direction perpendicular to the rotating direction of the rotating member) that jets the compressed air arranged in a region interposed between the surface of the rotating member and the surface of the peeling guide plate that faces the rotating member, and a portion of the one side of the peeling guide plate which is close to the surface of the rotating member, which faces a center of the advancing direction of the compressed air which is jetted by each of the nozzles and vicinities thereof project toward the surface of the rotating member.

With the above-mentioned structure, a portion of the leading end of the recording medium in the conveying direction, which is hit by the compressed air from the nozzle is peeled off into a floating state, and a portion of the one side of the peeling guide plate corresponding to the portion, which is close to the surface of the rotating member becomes a convex portion. Accordingly, the leading end of the recording medium which excellently floated by the compressed air is guided to the convex portion of the peeling guide plate, and the entire surface of the recording medium is successively peeled off. In this way, with the appropriate combination of the above peeling device according to the present invention with the peeling device according to the present invention, there can be provided the peeling device superior in terms of practical use without damaging the image, the recording medium and the rotating member including the fixing roll, while ensuring the extremely high peeling property and without adversely affecting the image quality.

A peeling member of the present invention is preferably applied to a fixing device in which an especially high peeling property is required. (Hereinafter, a member simply referred to as a "peeling member of the present invention" means both the fixing devices according to the present invention.) That is, according to the present invention, there is provided a fixing device which has at least a heat rotating member that rotates while a surface of the heat rotating member is heated, and a pressure rotating member which is abutted against the surface of the heat rotating member to form a nip portion, and in which a sheet-like recording medium whose surface has a toner image formed thereon with an unfixed toner passes through the nip portion so that the surface on which the toner image is formed is abutted against the surface of the heat rotating member to fix the toner image.

The fixing device includes a peeling device that peels off the recording medium that is conveyed while adhering to the surface of the heat rotating member due to the fused toner which forms the toner image after passing through the nip portion from the heat rotating member, and the peeling device includes the peeling device according to the present invention.

In the fixing device according to the present invention, the heat rotating member may be formed in a roll shape or an endless belt shape. Similarly, the pressure rotating member may be formed in a roll shape or an endless belt shape. That is, the fixing device according to the present invention can be applied to any type of fixing device such as the fixing device of the two-roll system, the fixing device of the roll-belt nip method, and the fixing device of the belt-belt nip method. It is needless to say that, in case of the roll-belt nip method, any one of the heat rotating member and the pressure rotating member may be formed in a roll or a belt. The above-mentioned belt may be stretched by plural rolls or free without being extended (free belt nip method).

Further, according to the present invention, there is provided an image forming apparatus, including:

a toner image forming unit that forms an unfixed toner image on a surface of a sheet-like recording medium through an electrophotographic process; and a fixing unit that fixes the toner image retained on the surface of the recording medium by heating and pressurizing, the fixing unit including the fixing device according to the present invention.

BRIEF DESCRIPTION OF THE DRAWINGS

Preferred embodiments of the present invention will be described in detail based on the following drawings, wherein:

FIG. 4(*b*) is a diagram showing the peeling guide plate in the peeling device shown in FIG. 1, and a further enlarged cross-sectional view of a section A—A of FIG. 4(*a*);

FIG. 11(*b*) is a diagram showing the peeling guide plate in the peeling device shown in FIG. 10, and a further enlarged cross-sectional view of a section H—H of FIG. 11(*a*);

DETAILED DESCRIPTION OF THE PREFERRED EMBODIMENT

Embodiment 1

Figure 1:
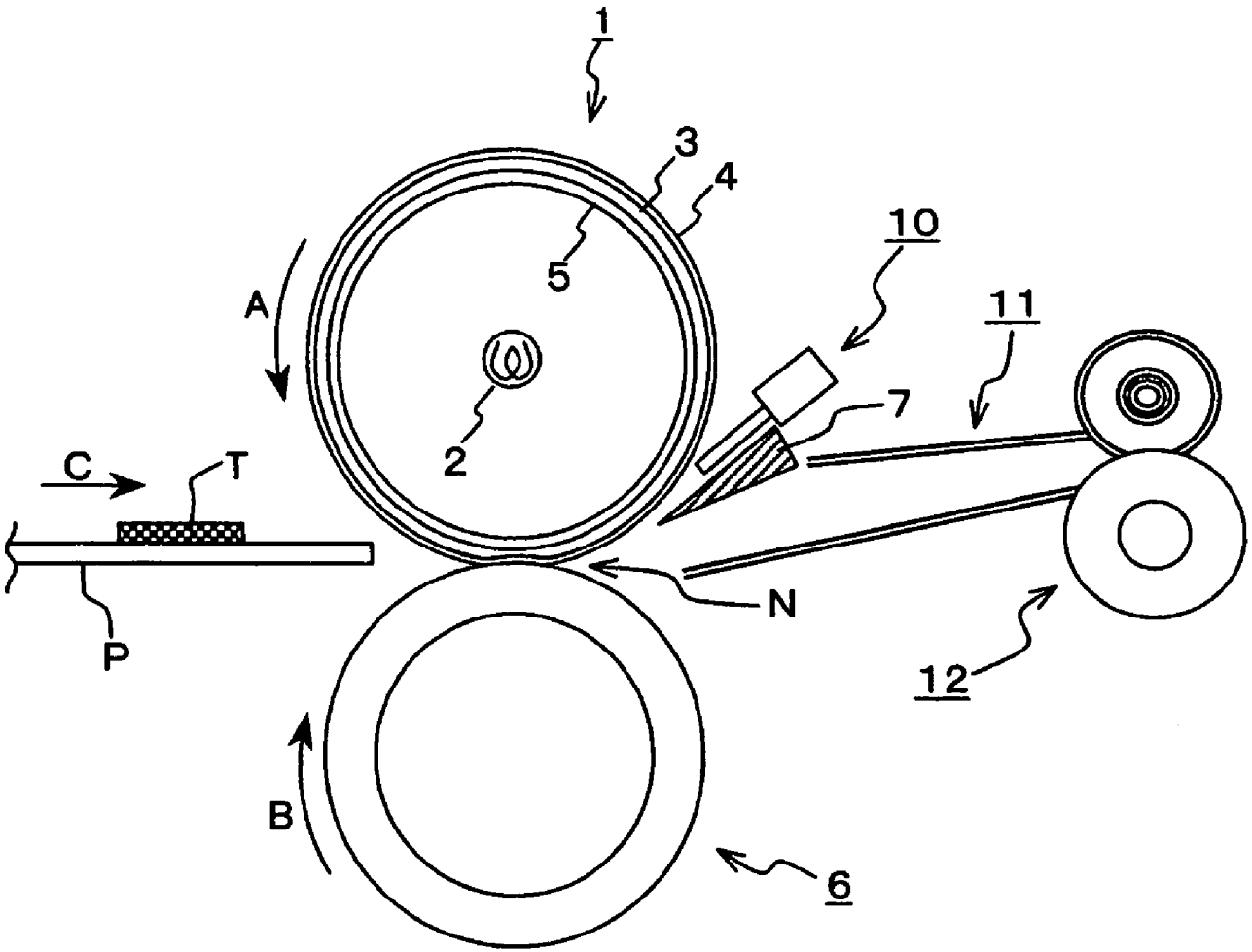
FIG. 1 is a schematic cross-sectional view showing a fixing device that applies a peeling device according to Embodiment 1 of the present invention.

FIG. 1 is a sectional view of a fixing device including peeling devices according to Embodiment 1 of the present invention. The peeling devices of this embodiment are a combination of a first aspect and a second aspect of the present invention, and are of a two-roll system.

The fixing device shown in FIG. 1 includes a fixing roll (heating rotating member) 1 which rotates in a direction shown by an arrow A and a pressure roll (pressure rotating member) 6 which is driven to rotate in a direction shown by an arrow B opposite to the rotation direction A of the fixing roll 1 while the pressure roll 6 is in contact with the fixing roll 1. A sheet (recording medium) P carrying a toner image T made from unfixed toner on its surface is conveyed in a direction shown by an arrow C and inserted into a nip portion N formed between the fixing roll 1 and the pressure roll 6 to be heated and pressurized by the pair of rolls 1 and 6 so that the toner of the toner image T is fused, thereby fixing the toner image T to the surface of the sheet P.

On a downstream side in the rotation direction A of the fixing roll 1 from the nip portion N of the fixing roll 1, a peeling guide plate 7 is disposed such that one of its sides is in close proximity to the surface of the fixing roll 1 and it is laid in the rotation direction A of the fixing roll 1. When the sheet P carrying the toner image T with molten toner is conveyed in the direction shown by the arrow C while it is inserted into the nip portion N, the sheet P is peeled off from the fixing roll 1 by the peeling guide plate 7. In an area between the surface of the fixing roll 1 and the surface opposed to that surface of the peeling guide plate 7, gas jetting devices (gas jetting units) 10 are arranged.

The fixing roll 1 in this embodiment corresponds to a "rotating member" of a peeling member of the first aspect of the present invention and a peeling member of this embodiment is provided to peel off the sheet P which is a recording medium from the fixing roll 1. In this embodiment, a self-stripping method is employed in which the sheet P is peeled off from the fixing roll 1 by itself, making use of a microslip produced by the elastic deformation of the fixing roll 1 caused by the pressure of the pressure roll 6 at an interface between the sheet P and the fixing roll 1. Although a satisfactory peeling property is obtained only by employing the self-stripping method under general fixing conditions, for example, for fixing a character image to plain paper, the peeling device of the present invention which includes the peeling guide plate 7 and the gas jetting devices 10 which will be described in detail hereinafter is provided in this embodiment, thereby making it possible to obtain a stable peeling property even under more harsh conditions.

The fixing roll 1 includes an aluminum core 5 having a thickness of 2 to 3 mm, an elastic layer 3 having a thickness of 0.5 to 3 mm formed on the core surface, a surface layer 4 having a thickness of 20 to 50 μm formed on the elastic layer 3, and a heater 2 as a heating source therein. In this embodiment, the elastic layer 3 is made from LSR (Liquid Silicone Rubber) having a rubber hardness of 25 to 45°. A PFA (tetrafluoroethylene-perfluoroalkylvinyl ether copolymer) tube is used for the surface layer 4. In this embodiment, the outer diameter of the fixing roll 1 is 65 mmϕ.

The material of the elastic layer 3 is not limited to the above silicone rubber and any conventionally known material may be used. For example, fluorine rubber may be used or an elastic laminate layer composed of plural silicone rubber and fluorine rubber layers may be used.

A so-called "hard roll" without an elastic layer may be used as the fixing roll.

Figure 2:
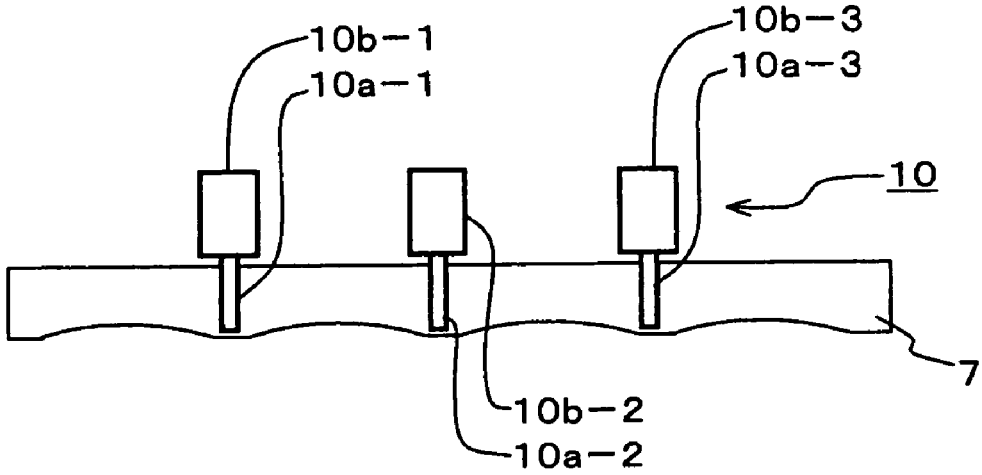
FIG. 2 is an enlarged plan view showing the peeling device of FIG. 1 as viewed from a fixing roll surface side.

FIG. 2 is an enlarged plan view of the peeling device in this embodiment, that is, the peeling guide plate 7 and the gas jetting devices 10 when seen from the surface side of the fixing roll 1. As shown in FIG. 2, in this embodiment, three gas jetting devices 10 are arranged in the longitudinal direction of the peeling guide plate 7. In the present invention, the number of the gas jetting devices is not limited. At least one gas jetting device may be provided and preferably plural gas jetting devices are provided. In this embodiment, the gas jetting devices 10 include air nozzles 10*a*-1, 10*a*-2, and 10*a*-3 having an inner diameter of 0.5 to 4 mm, electromagnetic valves 10*b*-1, 10*b*-2, and 10*b*-3 and gas feeders not shown in FIG. 2, respectively, so that a compressed gas stream (compressed gas) is delivered in the form of pulses from the air nozzles 10*a*-1, 10*a*-2, and 10*a*-3. The expression "form of pulses" means an air stream which is caused to flow not continuously but only one time for a short period of time (for example, 0.01 to 0.1 sec) or intermittently at a certain time interval.

Figure 3:
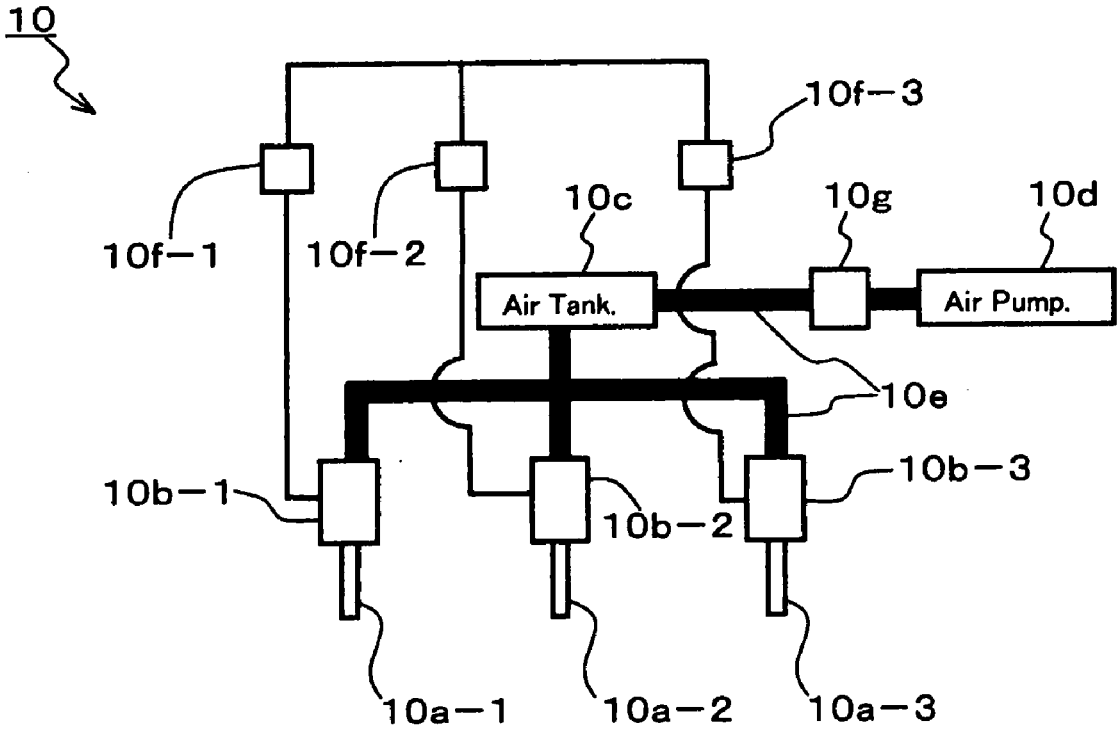
FIG. 3 is a schematic structural view showing an overall structure of an air jetting device in the peeling device shown in FIG. 1.

FIG. 3 is a diagram schematically showing the whole structure of the gas jetting devices 10. In FIG. 3, the gas feeders omitted in FIG. 2 are schematically shown and denoted by reference symbols 10*c* to 10*g*. That is, the gas feeders which constitute part of the gas jetting devices 10 are composed of an accumulator 10*c* for accumulating gas to be supplied to the air nozzles 10*a*-1, 10*a*-2, and 10*a*-3, an air pump 10*d* for producing compressed gas and supplying the gas with pressure, connection pipes 10*e* for connecting those components as shown in the drawing, air pulse controllers 10*f*-1, 10*f*-2, and 10*f*-3 for controlling the opening and closing of the respective electromagnetic valves 10*b*-1, 10*b*-2, and 10*b*-3, and a regulator 10 g for controlling the pressure of the compressed gas to be supplied from the air pump 10*d*.

The air nozzles 10*a*-1, 10*a*-2, and 10*a*-3 are connected to the respective electromagnetic valves 10*b*-1, 10*b*-2, and 10*b*-3, and their jet times and jet timings are controlled by electromagnetic valve opening and closing signals from the respective air pulse controllers 10*f*-1, 10*f*-2, and 10*f*-3. Further, the electromagnetic valves 10*b*-1, 10*b*-2, and 10*b*-3 are connected to the air pump 10*d* by the connection pipes 10*e* through the accumulator 10*c*, and the gas supplied from the air pump 10*d* with the pressure is temporarily trapped in the accumulator 10*c* and then supplied to the air nozzles 10*a*-1, 10*a*-2, and 10*a*-3 so that compressed gas is jetted. In the accumulator 10*c*, the gas supplied by the air pump 10*d* is accumulated until a predetermined pressure is achieved. At this point, the inside pressure of the accumulator 10*c* is monitored by a not-shown pressure meter installed in the vicinity of the accumulator 10*c* in a path of the connection pipe 10*e*.

Figure 4:
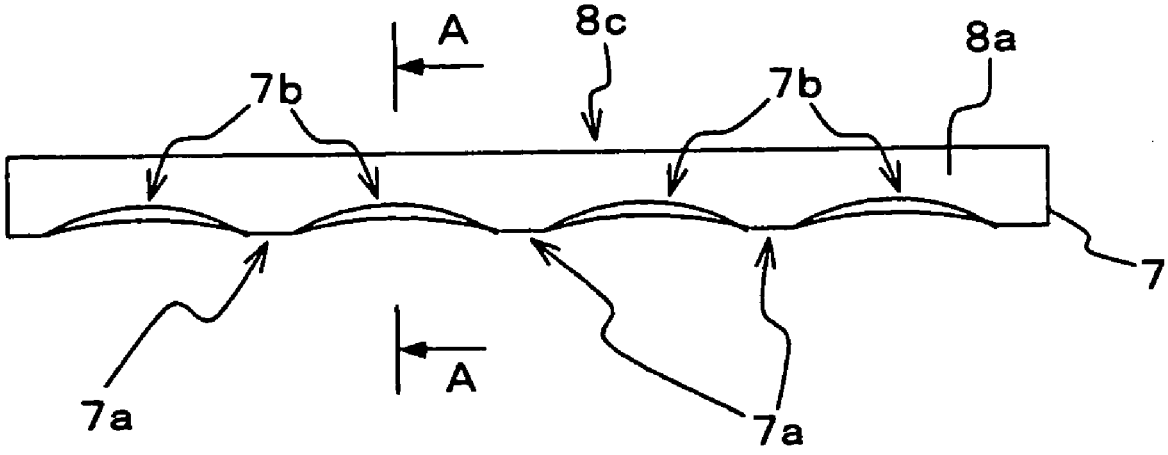
FIG. 4(*a*) is a diagram showing a peeling guide plate in the peeling device shown in FIG. 1, and an enlarged plan view as viewed from a surface opposite to the fixing roll surface side.
Figure 4:
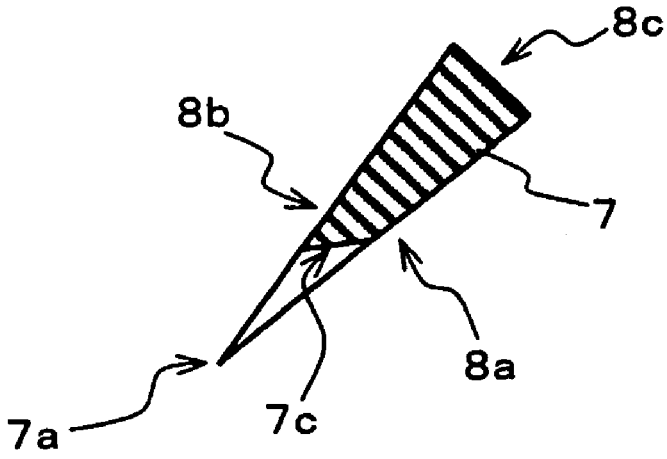

FIG. 4(*a*) is an enlarged plan view of the peeling guide plate 7 of the peeling device when seen from a side opposite to the side of FIG. 2 (i.e., a side opposite to the surface side of the fixing roll 1), and FIG. 4(*b*) is an enlarged sectional view cut on A—A of FIG. 4(*a*). As shown in FIG. 4(*b*), the cross-sectional shape of the peeling guide plate 7 is a wedge-like triangle having sides 8*a*, 8*b*, and 8*c*, and its apex having the acutest angle is in close proximity to the surface of the fixing roll 1. As FIG. 4(*b*) is a sectional view, the sides 8*a*, 8*b*, and 8*c* of the peeling guide plate 7 are all flat actually. Specifically, the side 8*b* is a face opposed to the surface of the fixing roll 1 (to be referred to as "rear face"), 8*a* is its rear face (to be referred to as "front face"), and 8*c* is an end face which is one side opposite to one side in close proximity to the surface of the fixing roll 1 (to be referred to as "end face").

The peeling guide plate in the present invention may include one having a not completely rectangular cross-sectional shape unlike the peeling guide plate 7 of this embodiment, and in specific, it includes a peeling guide plate having no flat form.

In this embodiment, one side in close proximity to the surface of the fixing roll 1 of the peeling guide plate 7 corresponding to the above apex portion is not straight and projects toward the surface of the fixing roll 1 as shown in FIGS. 4(*a*) and 4(*b*) (a form having at least one portion projecting toward the surface of the rotating member may be referred to as "deformed leading end shape" hereinafter). The deformed leading end shape in this embodiment is composed of convex portions 7*a* and concave portions 7*b* as shown in FIG. 4(*a*) (although both end portions project like the convex portion 7*a*, the end portions do not contribute to the peeling of the sheet in this embodiment and therefore are not included in the convex portions 7*a*. As a matter of course, when the end portions contribute to the peeling of the sheet, the end portions are considered as convex portions).

The convex portions 7*a* project such that their ends are aligned with one another and are provided at three locations in the longitudinal direction of the peeling guide plate 7. Meanwhile, the concave portions 7*b* are provided between the convex portions 7*a* and at both ends of the peeling guide plate 7 and are arched to be recessed. Further, the degree of recession of each concave portion 7*b* differs between the front and rear sides of the peeling guide plate 7. The concave portions 7*b* are more recessed on the front face 8*a* than on the rear face 8*b* and a face (7*c* in FIG. 4(*b*)) inclined from the front face 8*a* is formed at the center of the arc of each concave portion 7*b*.

The leading end in the conveying direction C of the sheet P peeled off by compressed gas delivered from the gas jetting devices 10 runs onto the front face 8*a* side of the peeling guide plate 7. Then, the sheet P is moved over the front face 8*a* by the revolution of the fixing roll 1 while being conveyed in slide contact with the front face 8*a*, whereby the sheet P is peeled off from the surface of the fixing roll 1 gradually until the whole sheet P is peeled off. That is, only the peeling of the leading end of the sheet P is carried out by the application of the compressed gas from the gas jetting devices 10 and the peeling of the subsequent portion to the rear end of the sheet is carried out by the peeling guide plate 7.

Figure 5:
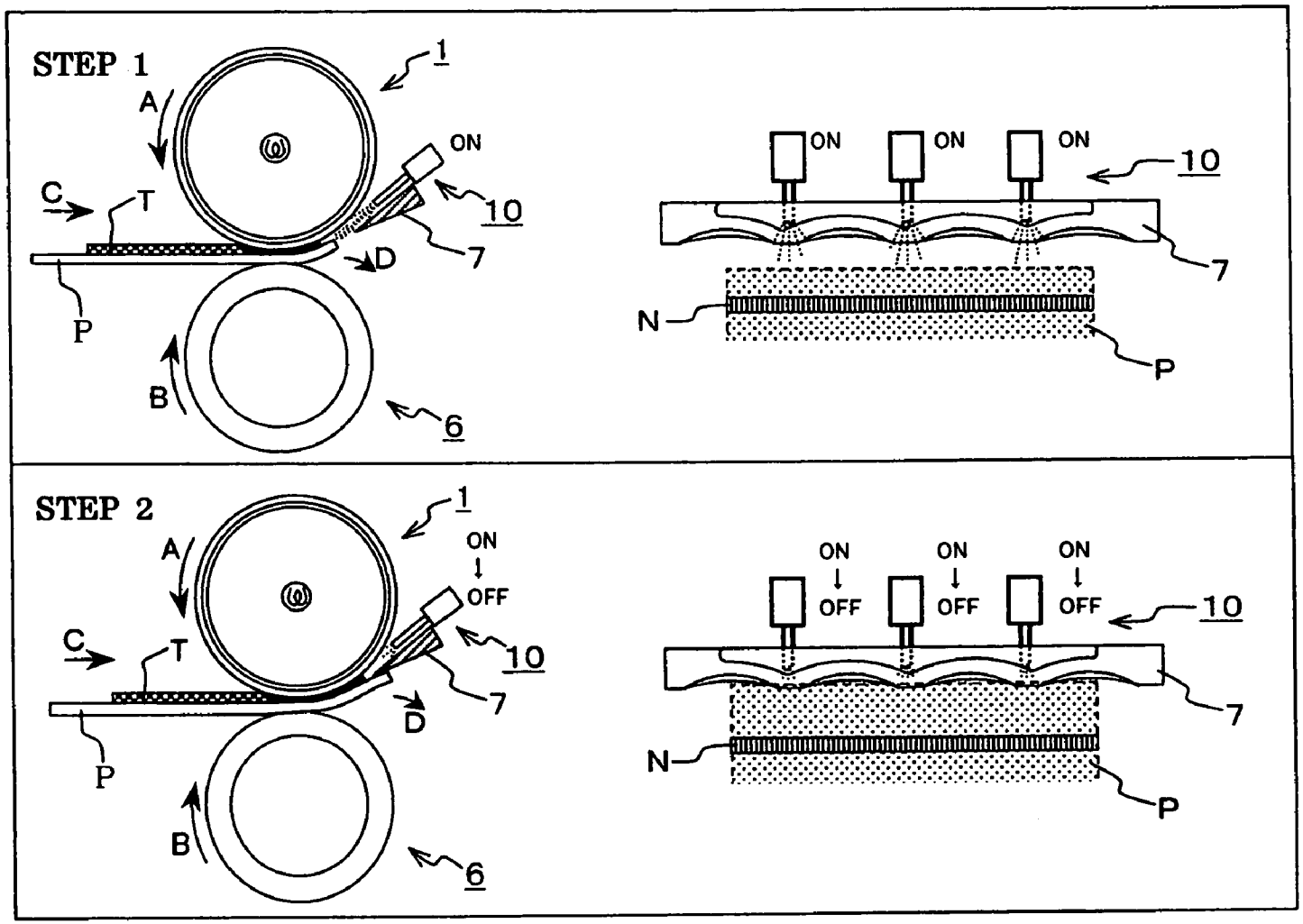
FIG. 5 is an explanatory diagram for explaining an action of the peeling device in step order in accordance with a first aspect of the present invention, which shows steps 1 and 2.
Figure 6:
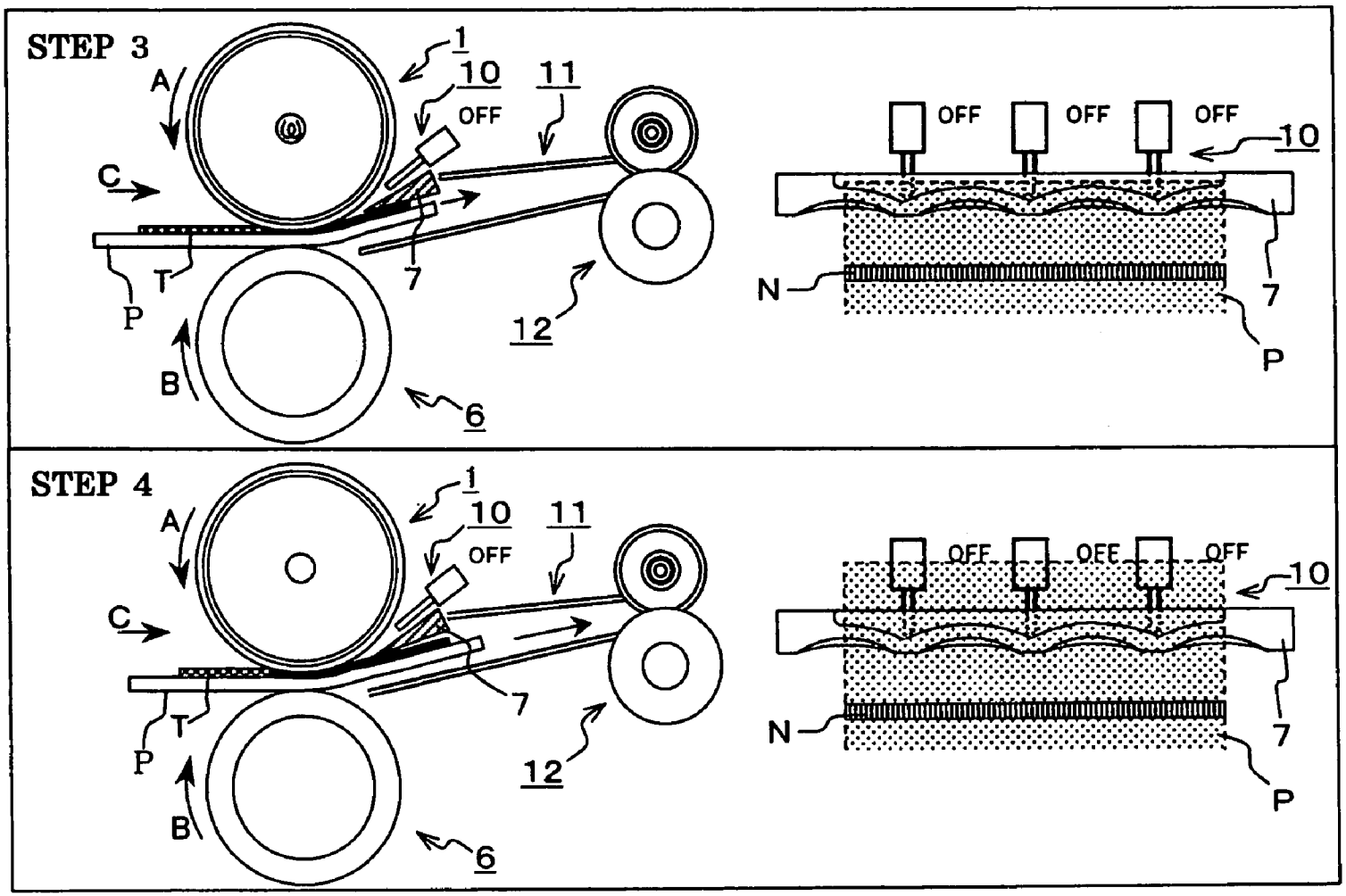
FIG. 6 is an explanatory diagram for explaining the action of the peeling device in step order in accordance with the first aspect of the present invention, which shows steps 3 and 4.

This function will be described in detail. FIGS. 5 and 6 are diagrams for explaining the function of the peeling device of the first aspect of the present invention in each step, taking the fixing device of this embodiment as an example. Step 1 and step 2 are shown in FIG. 5 and step 3 and step 4 are shown in FIG. 6. In each step, the drawings on the left side are sectional views when seen from the same direction as in FIG. 1 and the drawings on the right side are enlarged plan views of the peeling device and the sheet when seen from the opposite side to that of FIG. 2 (that is, seen from a side opposite to the surface side of the fixing roll 1). In FIGS. 5 and 6, "ON" and "OFF" mean on and off states through operations of the electromagnetic valves (10*b*-1, 10*b*-2, and 10*b*-3 in FIG. 3) in the gas jetting devices 10.

The following steps are shown as typical examples and the first aspect of the present invention is not limited to the steps of this embodiment.

The sheet (recording medium) P conveyed in direction shown by the arrow C and inserted into the nip portion N between the fixing roll (heating rotating member) 1 and the pressure roll (pressure rotating member) 6 comes out in a direction shown by the arrow D from the outlet of the nip portion N while it is closely adhered (stuck) to the surface of the fixing roll 1 functioning as a rotating member. After passing through the outlet of the nip portion N, the sheet P(recording medium) advances together with the surface of the fixing roll 1 while drawing a curve in the rotation direction (direction shown by the arrow A) and the leading end in the conveying direction C of the sheet P (may be simply referred to as "sheet end" hereinafter) near the air nozzles is peeled off from the surface of the fixing roll 1 by the compressed gas in the form of pulses delivered from the air nozzles of the gas jetting devices 10 and conveyed while the sheet end is floating (see step 1 in FIG. 5).

Since the compressed gas delivered from the air nozzles is satisfactory if it peels off the sheet end coming out from the nip portion N instantaneously, its pulse width (jet time) does not need to be set long. When the sheet end is peeled off and floats, one side (may be referred to as "end" hereinafter) in proximity to the surface of the fixing roll 1 of the peeling guide plate 7 installed while keeping a small gap with the surface of the fixing roll 1 is inserted between the sheet and the fixing roll 1, and the sheet end runs onto the end of the peeling guide plate 7. Before and after this stage, the delivery of the compressed gas ends (see step 2 in FIG. 5).

Thereafter, the subsequent portion after the leading end in the conveying direction C of the sheet P gradually runs onto the end of the peeling guide plate 7 and is moved in slide contact with the surface of the peeling guide plate 7 in accordance with the rotation of the fixing roll 1, whereby it is gradually peeled off from the surface of the above rotating member until the sheet P is entirely removed (see steps 3 and 4 in FIG. 6). Then, the sheet P is guided by delivery guide 11 to be delivered to the outside of the apparatus by delivery roll 12.

A release layer is preferably formed on the surface of the peeling guide plate 7 which is a smooth and flat surface or a curved surface having a small curvature. Since the toner image T in a molten state immediately after exiting the outlet of the nip portion N is supported by the entire surface of the flat peeling guide plate 7, even when its surface is slightly in slide contact with the peeling guide plate 7, the image is not damaged.

The peeling device of the first aspect of the present invention exhibits an extremely excellent peeling property due to the above function.

In this embodiment, the end of the peeling guide plate 7 has a deformed shape as described above and only portions (convex portions 7*a* in FIGS. 4(*a*) and 4(*b*)) corresponding to a portion peeled off instantaneously by the compressed gas project toward the surface of the fixing roll 1. In other words, only portions opposed to the centers in the traveling directions of the compressed gases delivered from the air nozzles and portions there around at the end of the peeling guide plate 7 project toward the surface of the fixing roll 1.

Therefore, only the convex portions 7*a* are provided to form a small gap with respect to the surface of the fixing roll 1 and the sheet P first runs onto these portions at the end of the peeling guide plate 7. At this point, the compressed air is not applied to portions (not exposed to the compressed gas) away from the air nozzles in a direction perpendicular to the conveying direction C at the leading end of the sheet P, and thus these portions remain stuck to the fixing roll 1.

However, since the end of the peeling guide plate 7 is inserted between the sheet P and the fixing roll 1 in portions peeled off by the compressed gas, as the sheet P is subsequently conveyed, it is gradually peeled off by the peeling guide plate 7 with the already peeled portions as starting points (the state of step 2 in FIG. 5). That is, portions not exposed to much of the compressed gas at the leading end of the sheet P are peeled off by the peeling guide plate 7 later as compared with the portions directly exposed to the compressed gas.

Thus, the peeling device of this embodiment first peels off the leading end of the sheet P coming out from the nip portion N while it is stuck to the fixing roll 1 with the compressed gas instantaneously and eventually peels off the whole sheet, with the end of the peeling guide plate 7 inserted between the sheet P and the fixing roll 1 in the peeled portions.

In the first aspect of the present invention, the end of the peeling guide plate desirably has a deformed shape. The peeling guide plate 7 of this embodiment has the above form as well. That is, in the first aspect of the present invention, portions opposed to the centers in the traveling directions of the compressed gases delivered from the above nozzles and portions therearound at the end of the peeling guide plate are preferably arranged in close proximity to the surface of the rotating member from which the sheet is peeled off, to form a small gap therebetween, more preferably aligned with one another in a linear fashion, whereas the other portions (away from the nozzles) are preferably away from the surface of the rotating member as the recording medium is peeled off later as these portions. Therefore, in this embodiment, portions opposed to the air nozzles (10*a*-1, 10*a*-2, and 10*a*-3 in FIG. 3) of the gas jetting devices 10 and portions therearound at the end of the peeling guide plate 7 are linear and project in closest proximity to the fixing roll 1, and portions away from the above portions opposed to the air nozzles are cut out in an arc form so that they become gradually farther from the surface of the fixing roll 1.

As a matter of course, in the first aspect of the present invention, it is not essential that the end of the peeling guide plate should be deformed and it may be linear. However, when it is deformed as in this embodiment, the pressure and jet time (pulse width) of the compressed gas to be delivered from the nozzles and further the number of the nozzles can be reduced, which is preferred in reducing the size and cost of the apparatus.

The air nozzles (10*a*-1, 10*a*-2, and 10*a*-3 in FIG. 3) of the gas jetting devices 10 are provided in an area sandwiched between the surface of the fixing roll 1 and the front face opposed to the above surface of the peeling guide plate 7 and the ends of the nozzles are situated further downstream in the rotating direction A of the fixing roll 1 than the gap formed between the end of the peeling guide plate 7 and the fixing roll 1.

Figure 7:
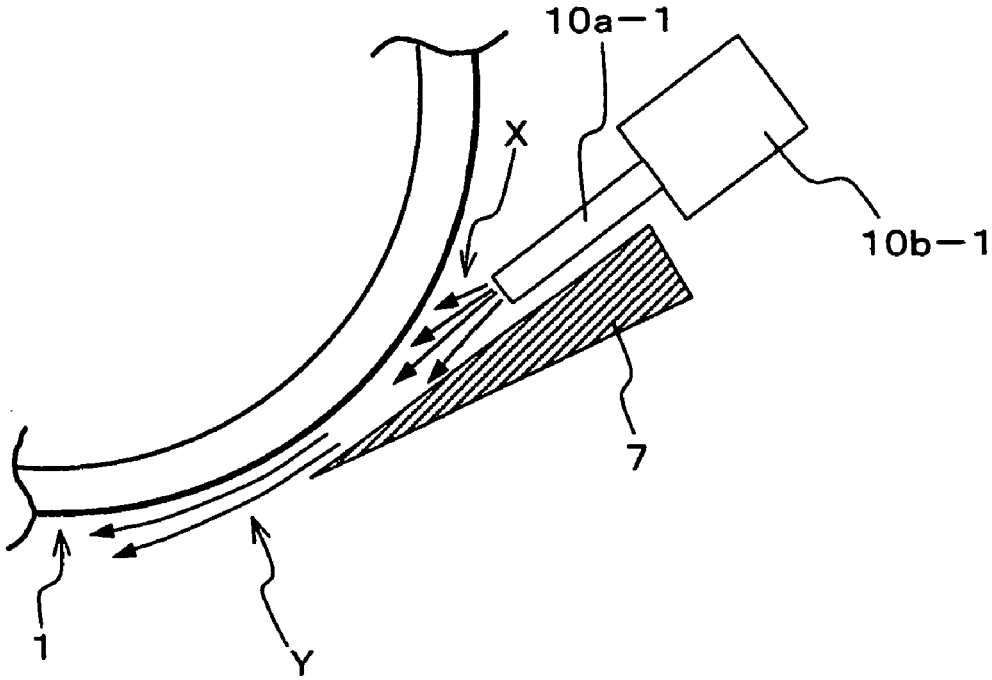
FIG. 7 is a schematic enlarged diagram for explaining a flow of a compressed air jetted from an air nozzle.

FIG. 7 is a schematic enlarged view for explaining a flow of the compressed gas delivered from the air nozzle (10*a*-1 out of the three air nozzles is shown as a typical example). As shown in FIG. 7, a linear air stream (initial air stream X) containing a slightly radial component delivered from the air nozzle 10*a*-1 is transformed into a flat (curtain-like) air stream (air stream Y having passed through a gap) when it passes through a slit-like gap formed between the end of the peeling guide plate 7 and the fixing roll 1. As the flat (curtain-like) air stream hits against the leading end of the sheet P while being almost linear, it can peel off the leading end of the sheet P the most efficiently as compared with air streams having other forms and the same volume. That is, by arranging the rotating member from which the sheet is peeled off, the peeling guide plate, and the gas jetting unit to achieve the positional relationship specified in the first aspect of the present invention, the recording medium can be peeled off with a smaller amount of gas and a smaller number of nozzles.

In this embodiment, the peeling guide plate 7 is made from a stainless steel material (SUS430) as a base material and has a fluorine resin layer having a thickness of 30 μm formed on the front face 8*a*, rear face 8*b*, and end face 8*c*. As a matter of course, in the present invention, the base material of the peeling guide plate is not limited to a stainless steel material and a heat resistant plastic material or other metal may be used.

In this embodiment, the end (specifically, the convex portions 7*a*) of the peeling guide plate 7 is arranged in close proximity to the surface of the fixing roll 1 in a non-contact manner. The width of the gap between the end (preferably the convex portions 7*a*) of the peeling guide plate 7 and the surface of the fixing roll 1 is selected from a range of 0.05 to 1 mm, more preferably a range of 0.1 to 1 mm. When this gap is too large, the direction of the sheet P is greatly changed by the peeling guide plate 7, thereby making it difficult for the sheet to slide smoothly over the end and the front face 8*a* of the peeling guide plate 7, which produces stress in the guide of the sheet to interfere with the peeling of the sheet. When this gap is too large, the requisite pressure and pulse width of the compressed gas may become large because the leading end of the sheet must be raised very high to make the leading end of the sheet run onto the end of the peeling guide plate 7 and the air stream Y having passed through the gap in FIG. 7 hardly becomes an appropriate flat (curtain-like) air stream. On the other hand, when the gap is too small, a resistance is imposed on the compressed gas when it passes through the gap, whereby the delivery force of the transformed flat (curtain-like) air stream maybe reduced. The gap may be suitably adjusted within the above range according to the pressure, jet timing, and jet time (pulse width) of the compressed gas delivered from the air nozzle 10*a*-1.

The air nozzles 10*a*-1, 10*a*-2, and 10*a*-3 are arranged between the peeling guide plate 7 and the surface of the fixing roll 1 such that it is sandwiched between them in a non-contact manner, particularly at a position where the ends of the delivery ports of the air nozzles approach the ends of the convex portions 7*a* of the peeling guide plate 7. When the ends of the delivery ports of the air nozzles are away from the ends of the convex portions 7*a*, the delivery force of the compressed gas to be applied to the leading end of the sheet P may weaken and effectiveness may be suppressed. Therefore, the ends of the delivery ports of the air nozzles are desirably arranged as close to the ends of the convex portions 7*a* of the peeling guide plate 7 as possible within such a range that they do not interfere with the surface of the fixing roll 1 and the peeling guide plate 7.

The peeling guide plate 7 is arranged such that it is laid in the rotating direction A of the fixing roll 1. The expression "laid in the rotating direction" as used herein means that the peeling guide plate as a whole is inclined in the rotating direction with respect to the normal of the rotating member passing through one side (end) in proximity to the rotating member (fixing roll 1) of the peeling guide plate (7). The degree of inclination is preferably such that the traveling direction of the recording medium to be peeled off from the surface of the rotating member is not changed as much as possible and desirably such that the tangent of the above rotating member at a point (peeling point) where the peeling of the recording medium from the surface of the rotating member starts and the rear face (front face 8*a*) opposed to the surface of the rotating member of the peeling guide plate become almost parallel to each other (angle between them is small).

Figure 8:
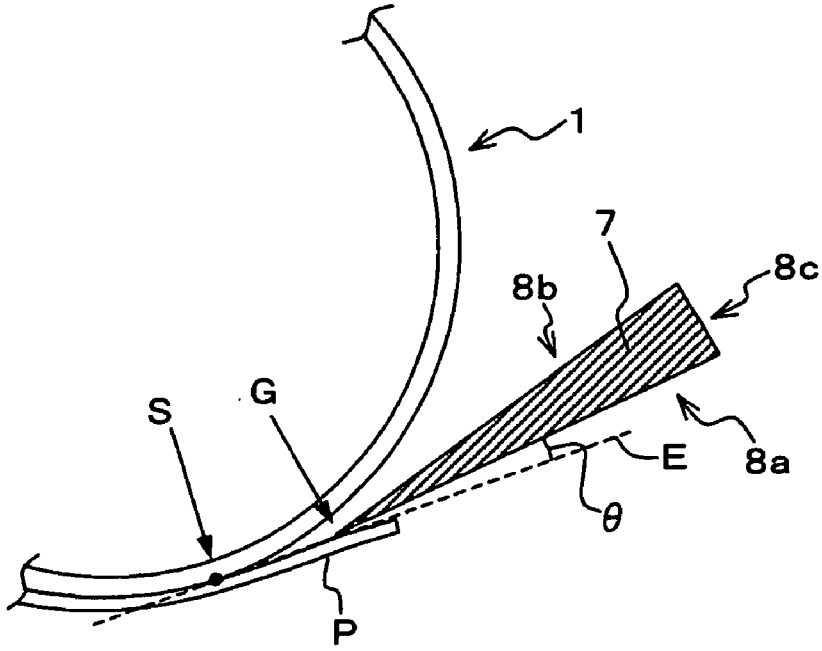
FIG. 8 is a partially enlarged cross-sectional view for explaining an arrangement relationship between a fixing roll that is a rotating member and a peeling guide plate.

The arrangement of the peeling guide plate will be described with reference to the accompanying drawing. FIG. 8 is a partially enlarged sectional view for explaining the arrangement relationship between the fixing roll as a rotating member and the peeling guide plate. In FIG. 8, the sheet P peeled off from the surface of the fixing roll 1 is enlarged and the structure other than the sheet P, fixing roll 1, and peeling guide plate 7 is not shown.

In FIG. 8, the sheet P conveyed while it is stuck to the surface of the fixing roll 1 is peeled off from the surface of the fixing roll 1 by the compressed gas from the not-shown gas jetting devices 10 at a peeling point S.

The leading end of the sheet P peeled off at the peeling point S runs over an end G of the peeling guide plate 7. FIG. 8 shows this state. The leading end and a portion therearound of the sheet P are conveyed, following substantially the same track as a tangent E at the peeling point S on the surface of the fixing roll 1. The closer the tangent E and the conveyance track of the sheet P, the more it is possible to make most of the rigidity of the sheet P itself can be made to peel off the sheet P, thereby making it possible to reduce the pressure and pulse width of the compressed gas and to peel off the sheet P smoothly.

Therefore, as for the position of the end G of the peeling guide plate 7, in addition to the requirement that the width of the gap satisfy the above range, it is preferably on the tangent E or on the fixing roll 1 surface side of the tangent E. The position is preferably as close to the tangent E as possible, the most preferably on the tangent E.

The angle θ between a straight line connecting between the peeling point S and the end G of the peeling guide plate 7 (shown as a straight line E as it is the same as the tangent E in FIG. 8) and the front face 8*a* of the peeling guide plate 7 is preferably −35° to +20°, more preferably as close to 0° as possible. When this angle is a large negative value (the front face 8*a* of the peeling guide plate 7 is farther from the surface of the fixing roll 1 than from the straight line E), the direction of the sheet P is greatly changed by the peeling guide plate 7, thereby making it difficult for the sheet P to slide over a face 8*c* and the front face 8*a* of the peeling guide plate 7 smoothly, which produces stress in the guide of the sheet to interfere with the peeling of the sheet. When the angle is a large positive value, it is difficult to arrange the gas jetting devices 10 at suitable positions.

Therefore, the best mode of the present invention is that the tangent E and the front face 8*a* of the peeling guide plate 7 are aligned with each other so that the sheet P is conveyed while following substantially the same track as the tangent E.

As for the peeling position (peeling point S) of the sheet P from the fixing roll 1, as the distance from the outlet of the nip portion N increases, the leading end of the sheet P is peeled off by the compressed gas more effectively. For example, when the leading end of the sheet P comes out by k (mm) from the outlet of the nip portion N and the delivery force F (N) of the compressed gas is applied to the leading end of the sheet P, as the sheet P is fixed with the outlet of the nip portion N as a fulcrum, a moment of approximately F×k is applied to the leading end of the sheet P. For this moment to overcome the adhesion force with which the sheet P is adhered to the fixing roll 1 and the rigidity of the sheet P with the outlet of the nip portion N as a fulcrum to guide the leading end of the sheet P to the end of the peeling guide plate 7, the value of k is preferably large. However, when k is too large, the time during which the sheet P is carried while it is wound around the fixing roll 1 becomes long and the toner image T carried on the surface of the sheet P is overheated, whereby the obtained image may become nonuniform in gloss. Therefore, the peeling point S at which the delivery force of the compressed gas is effectively applied to the leading end of the sheet P is set in consideration of image quality.

The position of this peeling point S may be suitably adjusted according to conditions such as the direction, pressure, and pulse width of the compressed gas delivered by the gas jetting devices 10, the thickness and rigidity of the sheet P in use, and the amount of toner of the toner image to be formed. In general, the position is adjusted to be a position where the above compressed gas is first applied.

In this embodiment, the convex portions 7*a* of the peeling guide plate 7 have a width substantially parallel to the axial direction of the fixing roll 1. The width which cannot be specified unconditionally is preferably selected from a range of 5 to 80 mm.

In this embodiment, the air nozzles 10*a*-1, 10*a*-2, and 10*a*-3 are provided independently between the peeling guide plate 7 and the fixing roll 1. In the first aspect of the present invention, they may be arranged such that they can deliver a pulse-like compressed gas from an area sandwiched between the surface of the rotating member and the surface of the peeling guide plate opposed to the above surface toward a gap between the surface of the rotating member and one side of the peeling guide plate in proximity to the rotating member. The positions of the air nozzles are not limited (for example, there is considered a mode of positions where the air nozzles 10*a*-1, 10*a*-2, and 10*a*-3 are more recessed). There is no problem if the peeling guide plate may serve as nozzles (for example, there is considered a mode in which nozzles project from the rear face 8*b* of the peeling guide plate 7 such that their openings are directed toward the gap between the surface of the fixing roll 1 and the end of the peeling guide plate 7).

The jet time (pulse width) of the compressed gas delivered from the air nozzles 10*a*-1, 10*a*-2, and 10*a*-3 which cannot be specified unconditionally as it is changed by various conditions is desirably about 0.01 to 0.1 sec.

When the jet time is longer than 0.1 sec, an extremely large amount of gas is delivered each time and high-speed continuous feeding of the sheet becomes difficult, with the result that the apparatus lacks general applicability. Further, a large-sized pump having a large gas feed capacity is needed as the air pump 10*d* and a large-capacity accumulator is needed as the accumulator 10*c*, thereby making the apparatus very bulky and boosting its cost, which might make it unrealistic.

When the jet time is shorter than 0.01 sec, the opening and closing response speeds of the electromagnetic valves 10*b*-1, 10*b*-2, and 10*b*-3 become slow and nonuniformity in the valve opening and closing timings becomes large, which might result in the lack of reliability.

This jet time may be suitably set according to the process speed of the sheet P and may be made variable according to the process speed. Besides this, the jet time of the compressed gas may be made variable according to the length (blank portion) from the end of the sheet P to the image portion where the toner image T is existent. In this case, the compressed gas can be applied only to the blank portion at the end of the sheet P so that the compressed gas is not applied to the toner image T. If there is almost no blank portion at the end of the sheet, the compressed gas can be inserted between the roll and the sheet in a wedge-like manner to peel off the sheet. Since the delivery amount of the compressed gas is very small as a whole, even if the compressed gas hits against the toner image T, it does not exert a large influence upon image quality usually.

The pressure of the compressed gas delivered from the air nozzles 10*a*-1, 10*a*-2, and 10*a*-3 is desirably set to 0.05 to 0.5 MPa or below. When the pressure exceeds 0.5 MPa, a large-sized pump having a large gas feed capacity is needed as the air pump 10*d*, thereby increasing the size of the apparatus and a measure against an air leak must be taken, thereby boosting the cost of the apparatus. To reduce the size of the apparatus and satisfactorily peel the end of the sheet at low cost, it is desirable that the amount of the compressed air to be delivered each time should be controlled by reducing the pressure. The compressed gas to be delivered from the air nozzles 10*a*-1, 10*a*-2, and 10*a*-3 can be applied to a high-speed copying machine and printer by selecting the minimum pressure required for the peeling of the leading end of the sheet P and the shortest jet time.

The pressure of the compressed gas may be made variable according to conditions such as the type and the process speed of the sheet P to be inserted. For example, when the sheet P has no rigidity and the toner image T is such that a lot of toner is existent up to a portion close to the leading end in the conveying direction C of the sheet P, toner having high adhesion is existent up to the leading end of the sheet P, making it difficult to peel off the sheet P from the fixing roll 1. Then, when the pressure of the gas to be delivered is set high in order to peel off the leading end of the sheet P with the strongly compressed gas, the sheet P can be peeled off without fail. The pressure of the air pump 10*d* is adjusted by the regulator 10 g interposed between the accumulator 10*c* and the air pump 10*d* or the like.

The amount of the compressed gas is determined by the pressure of the gas, the diameter of the orifice of each electromagnetic valve, the number of nozzles (three in this embodiment) and the opening time of each electromagnetic valve.

The gas used as the compressed gas is not particularly limited but air in the atmosphere is generally used as it is.

The temperature of the compressed gas to be delivered from the air nozzles 10*a*-1, 10*a*-2, and 10*a*-3 may be suitably controlled as required. To realize high image quality without nonuniformity, the temperature of the compressed gas to be delivered is preferably set higher than room temperature. If the difference between the temperature of the compressed gas and the temperature of the toner of the toner image T on the surface of the sheet P immediately after it passes through the nip portion N is large, nonuniformity in image quality may occur. Since there is a fear in that the toner whose temperature is still high may be cooled quickly, the temperature of the compressed gas is desirably set higher than room temperature.

The temperature of the compressed gas is preferably close to the softening point of the toner, more preferably close to the temperature of the toner of the toner image T immediately after the outlet of the nip portion N, that is, immediately after the sheet P is released from the fixing roll 1, the supply of heat ends and natural cooling begins by the radiation of heat. Stated more specifically, the temperature of the compressed gas is preferably within ±40° C. of the softening point of the toner, more preferably −5° C. to −80° C. from the surface temperature of the fixing roll 1.

The temperature of the peeling guide plate 7 may be controlled as required. Since the toner image T surface of the sheet P is guided to the delivery guide 11 while it is in slide contact with the front face 8*a* of the peeling guide plate 7 after the compressed gas is delivered, if the difference between the temperature of the toner of the toner image T on the surface of the sheet P delivered from the outlet of the nip portion N before it reaches the front face 8*a* of the peeling guide plate 7 and the temperature of the front face 8*a* of the peeling guide plate 7 is large, it may exert an influence upon image quality during the slide contact. Therefore, the temperature of the peeling guide plate 7 is preferably controlled to prevent the difference between both the temperatures from becoming large (the difference is preferably within 80° C., more preferably within 60° C.).

The method of controlling the temperature of the peeling guide plate 7 is not particularly limited. For example, a heater for heating the peeling guide plate 7 may be separately provided, or the remaining heat of the fixing roll 1 may be used.

In consideration for a case where the sheet P is skewed before it is inserted into the nip portion N, the opening and closing timings of the electromagnetic valves 10*b*-1, 10*b*-2, and 10*b*-3 connected to the respective air nozzles 10*a*-1, 10*a*-2, and 10*a*-3 may be controlled. That is, as the timing when the leading end of the sheet P reaches the peeling point of FIG. 8 is shifted in the direction perpendicular to the conveying direction of the sheet P when the sheet P is skewed, the opening and closing timings of the electromagnetic valves 10*b*-1, 10*b*-2, and 10*b*-3 are preferably controlled according to the shift.

Stated more specifically, the timing when the rear end in the traveling direction of the sheet P passes a predetermined position before it is inserted into the nip portion N is detected by plural sensors arranged in a direction perpendicular to the conveying direction of the sheet P to calculate the amount of skew from the detection signals so as to control the opening and closing timings (that is, the jet timing of the compressed gas) of the electromagnetic valves 10*b*-1, 10*b*-2, and 10*b*-3 according to the amount of the skew. If the sensors detect at least two locations of the rear end of the sheet P in the direction perpendicular to the conveying direction, the amount of the skew can be known.

In this embodiment, the number of the convex portions 7*a* of the peeling guide plate 7 and the number of the air nozzles 10*a*-1, 10*a*-2, and 10*a*-3 corresponding to those portions are three. It is needless to say that the first aspect of the present invention is not limited to this number. For example, 1 to 10 convex portions may be provided in the peeling guide plate and air nozzles may be provided corresponding to all the convex portions or an air nozzle(s) may be provided arbitrarily for some or only one out of those convex portions.

The utility of the first invention will be proved by verifying the specific structures of the fixing device and the peeling device of this embodiment. As for the numbers of air nozzles and the like which are specified in this embodiment, some of them may be studied as variable.

When the process speed of the sheet P to be conveyed to the nip portion N is represented by v (mm/sec), the length of the sheet P to be conveyed is represented by L (mm), and the inter-image between the sheets P to be continuously conveyed is represented by α (mm), conditions under which the compressed air (compressed gas) can be stably delivered are shown below. The conditions are represented by the following symbols and explained.

air feed capacity of air pump 10*d*: S (ml/sec)
capacity of accumulator 10*c*: T (ml)
set air pressure of accumulator 10*c*: $P_1$ (MPa)
atmospheric pressure: $P_0$ (MPa)

diameter of orifice of electromagnetic valves 10*b*-1, 10*b*-2, 10*b*-3: a (mm)

jet time of compressed air (opening time of electromagnetic valves): t (sec)

the number of air nozzles: n total delivery amount of compressed air per time: A (cc)

When the pressure reduced when the electromagnetic valves 10*b*-1, 10*b*-2, and 10*b*-3 are opened for t (sec) is represented by □p (MPa), the total delivery amount A of air per pulse is represented by the following equation (1).

$$A=\square p\times T/P_0(\text{ml}) \quad (1)$$

The compressed air is delivered from each air nozzle at a rate of A/n (ml).

Since air having a predetermined set pressure must be supplied to the accumulator 10*c* from the time when the sheet is conveyed and the compressed air is delivered until the time when the next sheet is conveyed and the compressed air is delivered again, the total delivery amount A of air per pulse may satisfy the following expression (2)

$$A\leqq(L+\alpha)XS/v \quad (2)$$

In the above expression (2), the left side shows the maximum amount of air which can be supplied from the air pump 10*d* to the accumulator 10*c* while the compressed air is not delivered between the first sheet to the next sheet.

For example, when a small-sized pump having an air feed capacity S of 8 liters/min (□ 130 ml/sec) was used as the air pump 10*d*, an accumulator having a capacity T of 200 ml was used as the accumulator 10*c* at an air pressure P1 of 0.3 MPa, the number (n) of air nozzles is 3, and the compressed air was delivered from the electromagnetic valves 10*b*-1, 10*b*-2, and 10*b*-3 having an orifice diameter a of 1.5 mm (air nozzle inner diameter of 2 mm) under the condition of a jet time t of 0.025 sec, □P was about 0.04 MPa. Therefore, the total delivery amount A of air is about 79 ml from the equation A=0.04×200/0.101 when the atmospheric pressure $P_0$ is 0.101 MPa. That is, the delivery amount of air per nozzle is about 26 ml.

When an A4-size sheet is long edge fed as the sheet P (that is, the length L of the sheet P=210 mm) at an inter-image α of 30 mm and a process speed v of 350 mm/sec, the maximum amount (L+α)×S/v of air which can be supplied from the air pump 10*d* to the accumulator 10*c* for a predetermined time during which the compressed air is not delivered from the first sheet to the next sheet is obtained from the following equation.

$$(L+\alpha)\times S/v=(210+30)\times 130/350$$

That is, it is about 89 ml which satisfies the above equation (2).

Therefore, it can be said that the air feed capacity of the air pump 10*d* and the capacity of the accumulator 10*c* in this case are within suitable ranges, and the compressed air having the same delivery force can be applied to the leading end of the sheet P at a high-speed continuous sheet feed rate of 350 mm/sec.

The conveyance distance □m (mm) of the sheet during the delivery of the compressed air (t (sec)) is □m=v×t. In the above case, it is 8.75 mm. The sheet P is conveyed while the compressed air is delivered. When the leading end of the sheet P coming out from the nip portion N reaches a predetermined position, the compressed air begins to be delivered and then an air stream is continuously applied to the leading end of the sheet P, whereby the leading end of the sheet P is conveyed while being moved in a direction away from the fixing roll 1 and is guided to the convex portions 7*a* of the peeling guide plate 7, thus completing delivery of the compressed air. Since the sheet P and a stream of the compressed air move relative to each other, the jet timing and jet time of the compressed air may be selected so that the leading end of the sheet P can be guided to the convex portions 7*a* of the peeling guide plate 7 according to the process speed of the sheet P.

Since A/n (ml=$cm^3$) of air is delivered from the orifices having a diameter a (mm) of the electromagnetic valves 10*b*-1, 10*b*-2, and 10*b*-3, the average flow velocity k (m/sec) of air near the orifice of each electromagnetic valve can be represented by the following expression (3) neglecting a loss.

$$K=(A/n)/\{(\pi a^2)\cdot t/4\}=4A/(n\pi a^2 t) \quad (3)$$

In the above example, $$K=4\times(79\times10^{-6})/\{3\times\pi\times(1.5\times10^{-3})^2\times0.025\}\square600.$$

That is, the average flow velocity k is about 600 m/sec.

Embodiment 2

Figure 9:
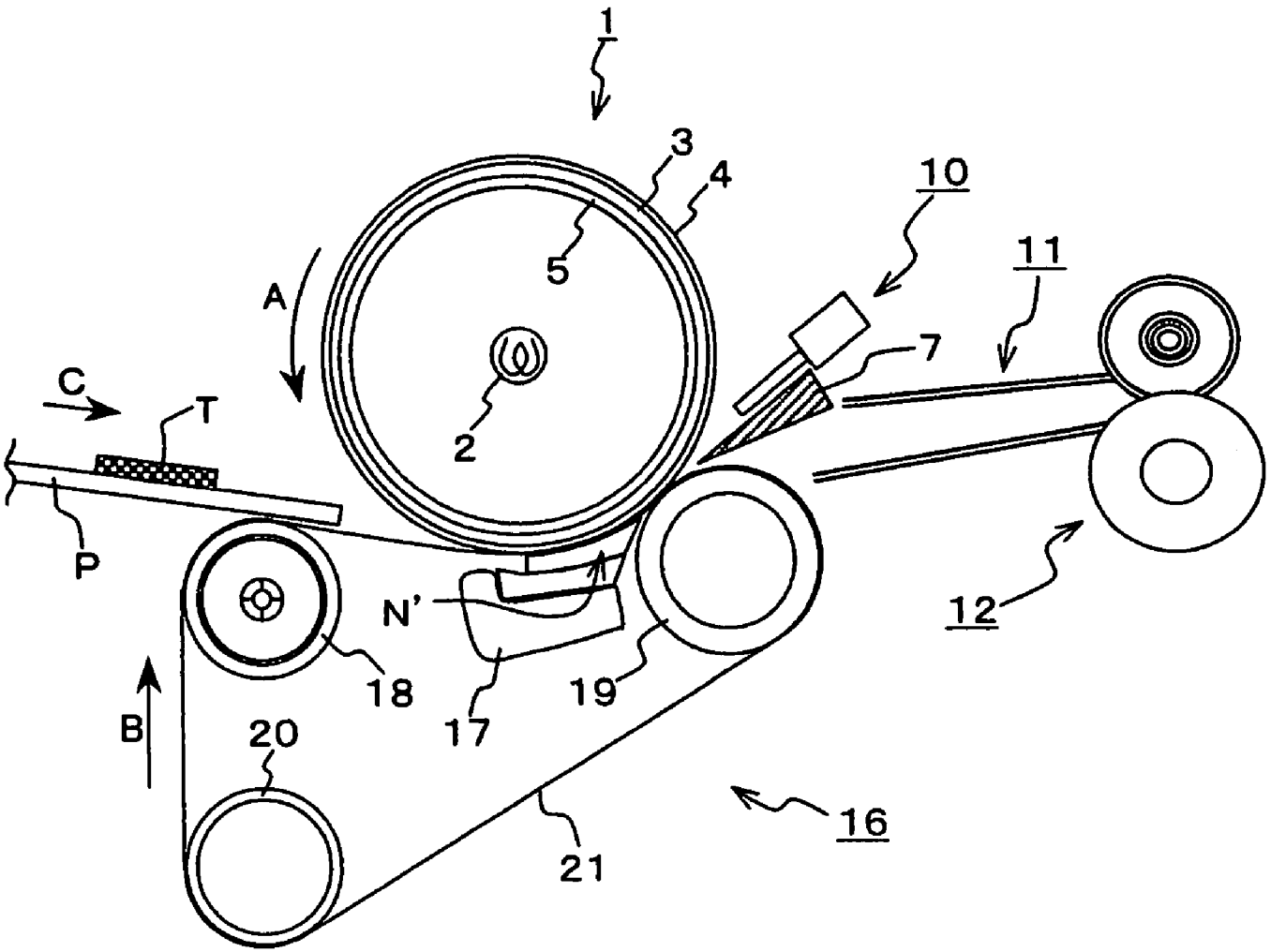
FIG. 9 is a schematic cross-sectional view showing a fixing device to which a peeling device in accordance with Embodiment 2 of the present invention is applied.

FIG. 9 is a sectional view of a fixing device adopting peeling devices according to Embodiment 2 of the present invention. The peeling devices of this embodiment are a combination of the first aspect and the second aspect of the present invention, and are of a roll-belt nip system. Since this embodiment is the same as Embodiment 1 in structure except the structure of the fixing device, in FIG. 9, members having the same function as those in Embodiment 1 are given the same reference symbols and their detailed descriptions are omitted.

The fixing device of this embodiment is essentially composed of a fixing roll 1, a pressure rotating member 16, and peeling devices 7 and 10.

The pressure rotating member 16 is essentially composed of an endless belt 21 stretched by three rolls consisting of a lead roll 18, a pressure roll 19, and a stretch roll 20, and a pressure pad (pressure member) 17 pressed against the fixing roll 1 by the endless belt 21.

The endless belt 21 contacts the fixing roll 1 such that it is wound around the fixing roll 1 at a predetermined angle to form a nip portion N'. On an inner side of the endless belt 21, the pressure pad 17 is arranged such that it is pressed against the fixing roll 1 by the endless belt 21.

The winding angle of the endless belt 21 around the fixing roll 1, which depends on the revolution of the fixing roll 1, is preferably set to about 20 to 45° to make the nip portion N' sufficiently wide. The winding angle is preferably set to ensure that the duel time (insertion time of the sheet P) of the nip portion becomes about 30 msec or more, specifically, about 50 to 70 msec.

The endless belt 21 is preferably composed of a base layer and a release layer formed on the front side (in contact with the fixing roll 1, or both sides) of the base layer. The base layer is formed from polyimide, polyamide, or polyamide-imide and has a thickness of preferably about 50 to 125 μm, more preferably about 75 to 100 μm. The release layer formed on the front side of the base layer by coating is made from the above-mentioned fluorine resin such as PFA, and has a thickness of 5 to 20 μm.

The pressure pad 17 includes, for example, an elastic member for ensuring the wide nip portion N' and a low-abrasion layer on the side in contact with the inner surface of the endless belt 21 of the elastic member, and is held by a metal holder or the like. The elastic member having the low-abrasion layer on the surface is curved almost in accordance with the peripheral surface of the fixing roll 1 and pressed against the fixing roll 1 to form the nip portion N', and the pressure roll 19 at a downstream of the nip in the conveying direction of the elastic member is strongly pressed against the fixing roll 1 by the endless belt 21 to produce a predetermined amount of distortion at that location of the fixing roll 1.

The elastic member of the pressure pad 17 may be made of an elastic member having high heat resistance such as silicone rubber or fluorine rubber or of a leaf spring. The low-abrasion layer formed on the elastic member is provided to reduce slide resistance between the inner surface of the endless belt 21 and the pressure pad 17, and preferably has a small friction coefficient and abrasion resistance. Specifically, a glass fiber sheet impregnated with Teflon (R), fluorine resin sheet, or fluorine resin coating film may be used.

The endless belt 21 is moved in the direction shown by the arrow B by the revolution of the fixing roll 1 in the direction shown by the arrow A.

The sheet P having the toner image T formed on the surface is conveyed from the left side in FIG. 9 toward the nip portion (direction shown by the arrow C). The toner image T formed on the surface of the sheet P inserted into the nip portion is fixed by pressure applied to the nip portion and heat given by the heater 2 through the fixing roll 1. A stable fixing property can be ensured by fixing with the fixing device of this embodiment because the wide nip portion can be ensured.

As described above, the pressure roll 19 is pressed against the fixing roll 1 at the outlet of the nip portion N' to give distortion to the elastic layer 3 of the fixing roll 1. Due to this structure, the nip portion N' is secured and the distortion of the fixing roll 1 is made large locally at the outlet of the nip portion N'.

According to the fixing device of this embodiment, the amount of distortion of the fixing roll 1 near the outlet of the nip portion N' can be made relatively large. Since the amount of distortion is made large, self-stripping becomes possible and a high releasing property can be obtained without using a releasing agent (oil). As a matter of course, oil may be used to obtain a high releasing property. When oil is used, the materials of the surface layers of the fixing roll and the belt may be suitably changed.

However, as described above, to enable more stable peeling of the sheet P even under conditions, such as a large amount of the toner of the toner image T, the toner image T existent nearly up to the end of the sheet P, low basis weight of the sheet P, and a thin coated sheet P, which make the peeling difficult the use of the peeling device of the first aspect of the present invention is effective. In this embodiment, the same peeling devices 7 and 10 as in Embodiment 1 are used to obtain an extremely high peeling property.

As the structure, preferred modes, and variations of the peeling devices 7 and 10 are the same as those in Embodiment 1, their detailed descriptions are omitted.

Embodiment 3

Figure 10:
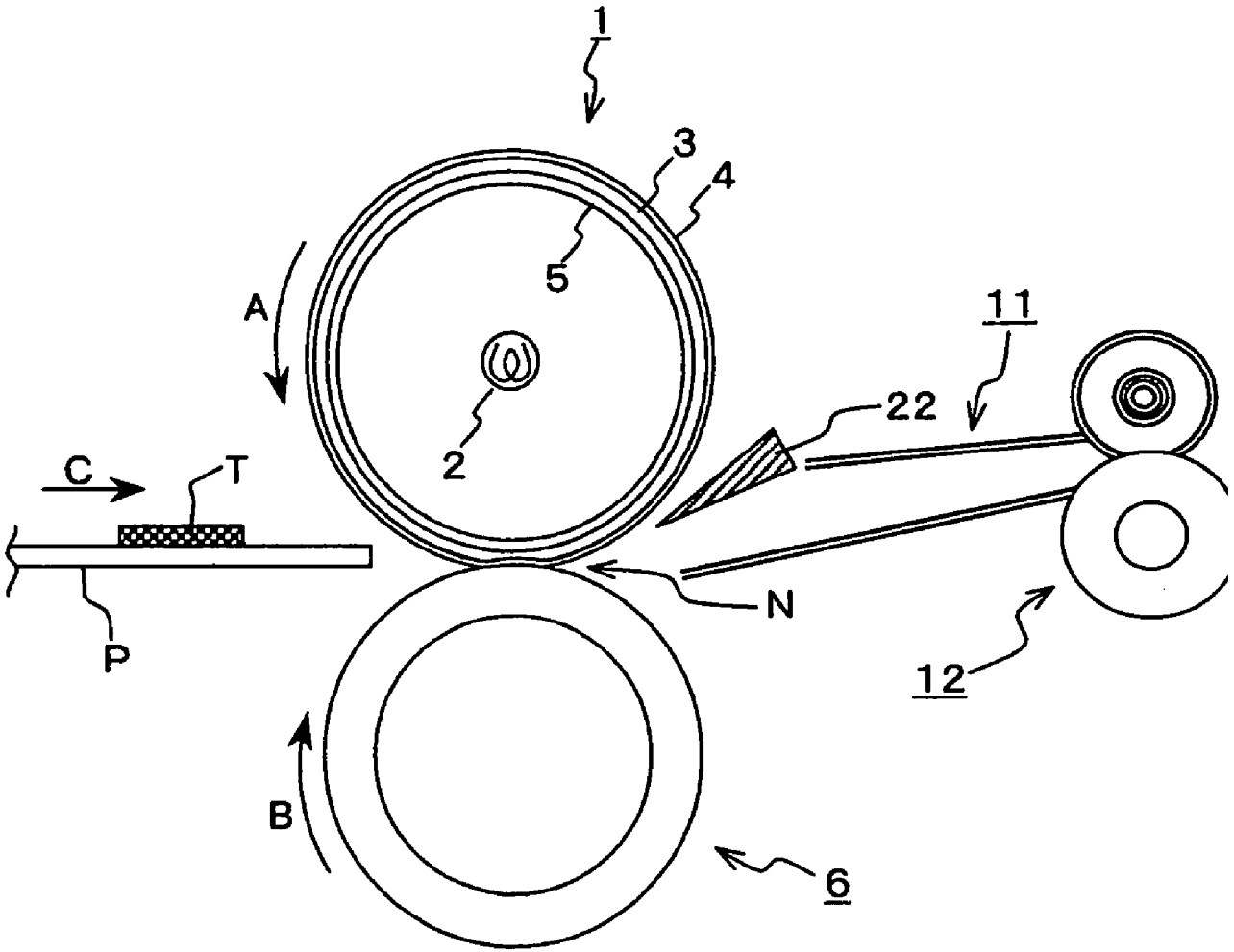
FIG. 10 is a schematic cross-sectional view showing a fixing device to which a peeling device in accordance with Embodiment 3 of the present invention is applied.

FIG. 10 is a sectional view of a fixing device adopting a peeling device according to Embodiment 3 of the present invention. The peeling device of this embodiment is an example of the first aspect of the present invention and the fixing device is of a two-roll system. Since this embodiment is the same as Embodiment 1 in structure except the structure of the peeling device, in FIG. 10, members having the same function as those in Embodiment 1 are given the same reference symbols and their detailed descriptions are omitted. Therefore, in this embodiment, only the peeling device will be basically described.

Figure 11A:
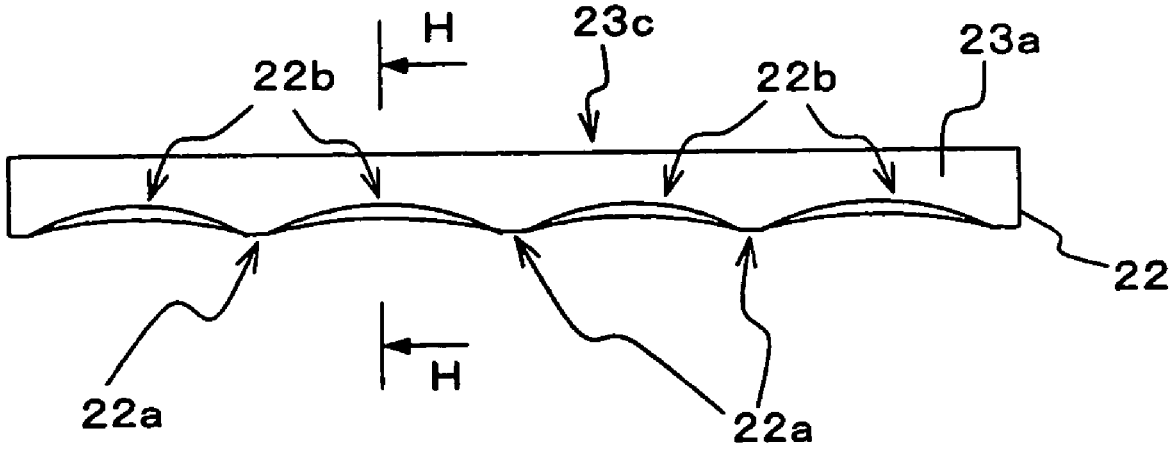
FIG. 11(*a*) is a diagram showing the peeling guide plate in the peeling device shown in FIG. 10, and an enlarged plan view as viewed from a surface opposite to the fixing roll surface side.
Figure 11B:
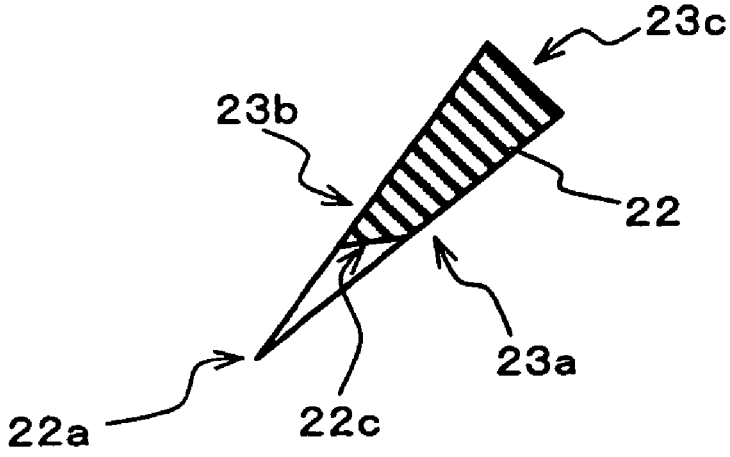
Figure 12A:
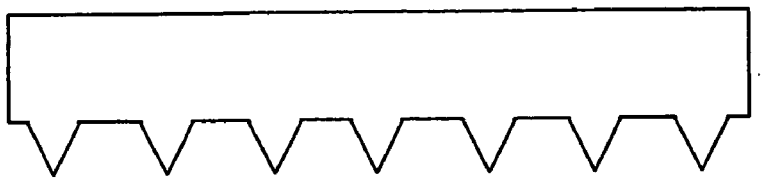
FIGS. 12(*a*) to 12(*d*) are plan views showing a modification of a deformed leading end shape of the peeling guide plate which can be applied as a second aspect of the present invention.
Figure 12B:
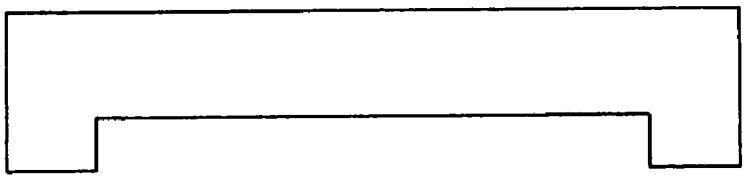
Figure 12C:
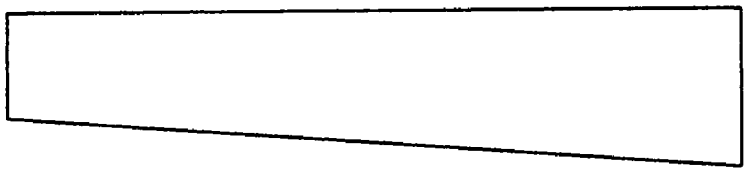
Figure 12D:
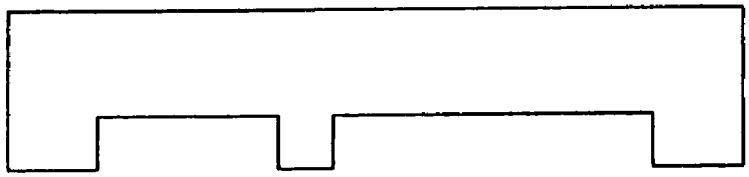

In this embodiment, as shown in FIGS. 11(*a*) and 11(*b*), only a peeling guide plate 22 is provided as the peeling device. FIG. 11(*a*) is an enlarged sectional view of the peeling guide plate 22 when seen from a side opposite to the surface of the fixing roll 1 and FIG. 11(*b*) is an enlarged sectional view cut along H—H of FIG. 11(*a*). As shown in FIG. 11(*b*), the cross-sectional shape of the peeling guide plate 22 is a wedge triangle having sides 23*a*, 23*b*, and 23*c* as a whole and the apex having the acutest angle is in close proximity to the surface of the fixing roll 1. Since FIG. 11(*b*) is a sectional view, the sides 23*a*, 23*b*, and 23*c* of the peeling guide plate 22 are actually all flat. Specifically, the side 23*b* is a face opposite to the surface of the fixing roll 1 (to be referred to as "rear face"), the side 23*a* is an opposite face (to be referred to as "front face") and the side 23*c* is an end face which is a side opposite to one side in proximity to the surface of the fixing roll 1 (to be referred to as "end face").

In this embodiment, one side in proximity to the surface of the fixing roll 1 of the peeling guide plate 22 corresponding to the apex portion is not straight and projects toward the surface of the fixing roll 1 as shown in FIGS. 11(*a*) and 11(*b*) (as described above, this form may be referred to as "deformed shape"). The deformed shape is composed of convex portions 22*a* and concave portions 22*b* as shown in FIG. 11(*a*) (although both end portions project like the convex portions 22*a*, in this embodiment they are not included in the convex portions 22*a* because they do not contribute to the peeling of the sheet. As a matter of course, when the end portions contribute to the peeling of the sheet, they are considered as convex portions).

The convex portions 22*a* project such that their ends are aligned with one another and are provided at three locations in the longitudinal direction of the peeling guide plate 22. Meanwhile, the concave portions 22*b* are provided between the convex portions 22*a* and at both ends of the peeling guide plate 22 and are recessed in an arc-like shape. Further, the degree of recession of each concave portion 22*b* differs between the front and rear faces of the peeling guide plate 22. The concave portions 22*b* are more recessed on the front face 23*a* than on the rear face 23*b* and a face (22*c* in FIG. 11(*b*)) inclined with respect to the front face 23*a* is formed at the center of the arc of each concave portion 22*b*.

The fixing device of this embodiment is such that the concave portions 22*b* of the peeling guide plate 22 having this form as a peeling device are arranged in proximity to the surface of the fixing roll 1.

Near the outlet of the nip portion N, force for peeling the sheet P from the surface of the fixing roll 1 is applied to the sheet P. However, under conditions such as a large amount of the toner of the toner image T, the toner image T existent nearly up to the end of the sheet P, low basis weight of the sheet P, and a thin coated sheet P, which make peeling of the sheet P difficult, the sheet may be partly peeled from the surface of the fixing roll 1 due to its own rigidity while other portions of the sheet are not peeled. In this case, when one side in proximity to the fixing roll of the peeling guide plate 22 is straight, is apart from the surface of the fixing roll 1, and is parallel to the surface of the fixing roll 1 (at equal intervals), the portion of the sheet peeled from the surface of the fixing roll 1 is to advance toward the rear face side (front face 23*a* side) of the face opposed to the surface of the fixing roll 1 of the peeling guide plate 22 and the portion of the sheet not peeled from the surface of the fixing roll follows the surface of the fixing roll 1 and is to advance toward the face (rear face 23*b* side) opposed to the surface of the fixing roll 1 of the peeling guide plate 22. That is, the leading end of the sheet P has portions that try to advance toward the both faces of the peeling guide plate 22, causing the leading end to hit against the leading end of the peeling guide plate 22, thus distracting peeling of the sheet P. In addition, a conveyance failure such as jamming occurs.

According to this embodiment, when the convex portions 22*a* and the concave portions 22*b* are formed on one side in proximity to the surface of the fixing roll 1 of the peeling guide plate 22, if at least portions corresponding to the convex portions 22*a* at the leading end of the sheet P are peeled, the sheet P runs over the convex portions 22*a*. Even if portions corresponding to the concave portions 22*b* at the leading end of the sheet P do are not peeled at this point, as the concave portions 22*b* are recessed in the conveying direction C of the sheet P, the leading end of the sheet P is not caught. Along with the movement of the sheet in accordance with the revolution of the fixing roll 1, the portions that are not peeled are led by the peeled portions which run onto the convex portions 22*a* of the peeling guide plate 22 to be gradually peeled. Thus, the whole sheet P is satisfactorily peeled.

In this embodiment, as in Embodiments 1 and 2, because the peeling guide plate 22 is apart from the surface of the fixing roll 1 and does not cause the sheet P to be mechanically and forcedly peeled off therefrom, peeling is achieved without damaging the fixing roll 1, the sheet P and the toner image T formed on the surface of the sheet P. In addition, because the image is in contact with the peeling guide plate 22 on the front face 23*a* after peeling, the image quality is not deteriorated.

Since the action of this embodiment is effective only when the portions of the leading end of the sheet P which are not peeled off from the surface of the fixing roll 1 correspond to the retreat portions (concave portions 22*b*) of the peeling guide plate 22, whether the effect of this embodiment is obtained or not is the theory of probability. However, the peeling property in this embodiment is surely improved as compared with a state in which one side of the peeling guide plate 22 that is close to the fixing roll 1 is linear, and disposed apart from the surface of the fixing roll 1 in parallel (at regular intervals).

In this embodiment, the deformed leading end shape of the peeling guide plate 22 is made up of the convex portions 22*a* that are narrow in the widthwise direction of the leading end and the concave portions 22*b* that retreat in an arcuate shape, which are disposed between the respective convex portions 22*a* and both ends of the peeling guide plate 22. Different from Embodiments 1 and 2, the linear portion of the convex portions 22*a* is narrow in width, which is because when the total length of the convex portions from the peeling guide plate 22 is set to be shorter, the probability that the peeling guide plate 22 allows the portions of the leading end of the sheet P which are not peeled off from the surface of the fixing roll 1 becomes high, to thereby improve the peeling property.

The deformed leading end of the peeling guide plate 22 according to this embodiment is shaped as shown in FIGS. 11(*a*) and 11(*b*). However, the peeling guide plate according to the second aspect of the present invention is not limited to this shape, and any shape is acceptable as long as one side of the peeling guide plate which is close to the surface of the rotating member is so shaped as to provide at least one portion that is projected toward the surface of the rotating member. As long as the convex portion from one side is disposed anywhere, the probability that the effect of the present invention is obtained becomes higher than a case in which no convex portion is provided.

A modified example of the deformed leading end shape of the peeling guide plate 22 which is applicable to the second aspect of the present invention is shown in plan views of FIGS. 12(*a*) to 12(*d*). In FIGS. 12(*a*) to 12(*d*), the lower side in the drawing shows the side having the deformed leading end shape. The configuration of the respective peeling guide plates in the thickness direction is omitted in the drawing.

FIG. 12(*a*) shows an example in which seven convex portions (i.e. "convex portions") which are pointed in an acute-angled shape are provided as the deformed leading end shape. In this case, the total length of the convex portions which are close to the rotating member to be peeled off becomes extremely short, and the probability that the peeling guide plate 22 allows the portions of the leading end of the recording medium which are not peeled off from the surface of the rotating member is high, and the peeling property is relatively high.

Also, for example, in the peeling operation at the time of fixing, because the toner image is not generally formed on both end portions of the leading end of the recording medium in the conveying direction, it is effective that only the portions corresponding to both end portions, that is, both ends of one side of the peeling guide plate are projected as shown in FIG. 12(*b*) Peeling after the fixing operation occurs on both end portions where no toner image is formed, with the higher probability in the leading end of the recording medium in the conveying direction, and the convex portions effectively act on the peeling operation. Therefore, the peeling property is extremely high. In this situation, the width of the convex portions may be set to an appropriate value, taking into consideration the width of the recording medium in a direction perpendicular to the conveying direction and an area where the toner image can be formed.

Likewise, as shown in FIG. 12(*c*), it is effective that only one end of one side of the peeling guide plate is projected and linearly retreated toward the other end thereof. When only one end of one side of the peeling guide plate runs on the leading end of the peeling guide plate, the peeling property is extremely high, because the peeling operation is successively advanced on the retreated linear leading end while conveying the recording medium, and the entire surface of the recording medium is finally peeled off. Also, when it is assumed that the toner image is formed on one of both ends of the leading end of the recording medium in the conveying direction, it is effective that the peeling guide plate having the deformed leading end shape of this example is applied, and one end of one side of the peeling guide plate which corresponds to one end where the toner image formation is assumed is retreated.

In addition, in the case where the recording medium to be used is of various sizes, it is effective to provide concave portions in correspondence with the width in a direction perpendicular to the conveying direction as shown in FIG. 12(*d*). In the case of using the peeling guide plate shown in FIG. 12(*d*), for example, in the conveyance of the A4-size sheet in the longitudinal direction, the convex portions on both ends of the peeling guide plate effectively acts on both end portions of the recording medium in the longitudinal direction where no image is formed. In the conveyance of the A4-size sheet in the lateral direction, the convex portions that exist on one end (right end in the drawing) of the peeling guide plate and on the way of one side thereof effectively act on both end portions of the recording medium in the lateral direction where no image is formed. Appropriate peeling properties are thus ensured, respectively.

Also, the deformed leading end shape described in Embodiment 1 above may be applied to this embodiment. As for the deformed leading end shape, the peeling property can be remarkably improved by projecting an appropriate portion in accordance with the environments where the peeling device is located, the application state, and a state in which the recording medium and the rotating member adhere to each other.

The peeling device according to the present invention and the fixing device using the peeling device were described with reference to three examples of the fixing device according to Embodiments 1 to 3. However, the present invention is not limited to the above examples. For example, it is possible that the respective structural elements described with the above-mentioned three embodiments are mutually replaced with each other.

Also, in the above-description, the fixing device was exemplified by the fixing device of the two-roll system, and the roll-belt nip method in a state where the belt is put around plural rolls. Likewise, the peeling device according to the present invention can be appropriately applied to the fixing device of the free belt nip method or the belt-belt nip method. However, in the case where the rotating member to be peeled off is belt-shaped, it is necessary that a position at which the peeling guide plate is mounted is set to a region where the surface of the rotating member is advanced while drawing a curve in the rotating direction, or downstream of the region.

Figure 13:
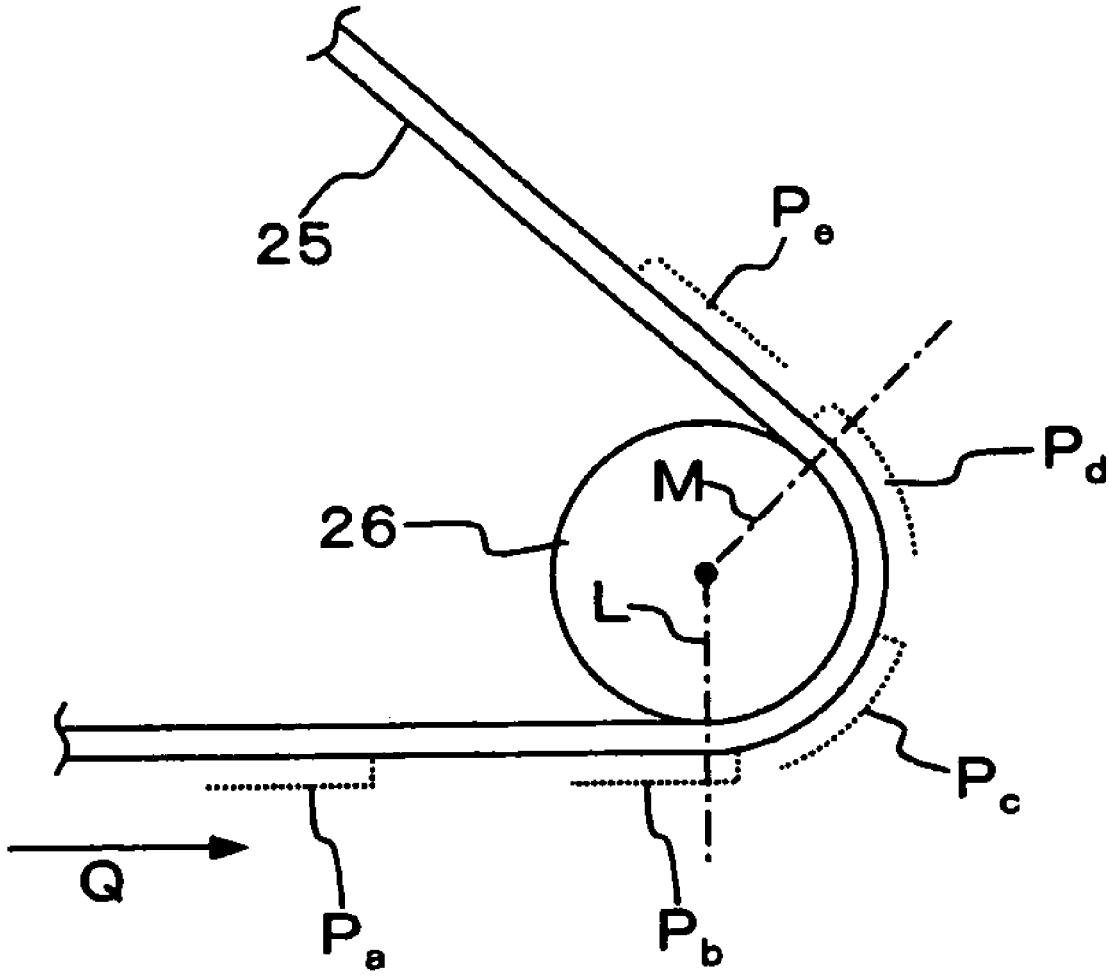
FIG. 13 is an explanatory diagram showing results of evaluating an applied range of the peeling device in accordance with an embodiment of the present invention.

FIG. 13 is an enlarged cross-sectional view for explaining a close contact state of the belt-like rotating member to be peeled off with the sheet. The figure is used for considering the position at which the peeling guide plate is mounted. In FIG. 13, reference numeral 25 denotes a belt-like rotating member which is put around a roll 26 and other rolls which are not shown, and which rotates in a direction indicated by an arrow Q.

The recording medium is conveyed in the direction indicated by the arrow Q in a state where the recording medium to be peeled off is in close contact with (adheres to) the surface of the rotating member 25 while the rotating member 25 rotates. In FIG. 13, assuming that the recording medium is left in close contact with the surface of the rotating member 25, only the leading ends of the recording medium $P_a$ to $P_e$ that move while being conveyed are indicated by dotted lines.

The peeling force caused by the rigidity of the recording medium is not exerted on the leading end of the recording medium $P_a$ that has been conveyed in the direction indicated by the arrow Q in the state where the recording medium $P_a$ is in close contact with the surface of the rotating member 25, because the rotating member 25 is advanced linearly in the rotating direction.

Because the rotating member 25 is put around the roll 26, the rotating member 25 is advanced while drawing a curve in the rotating direction at the point where the rotating member 25 is put on the roll 26 and the advancing direction of the rotating member 25 is switched. More specifically, in a region partitioned between a line L and a line M, the rotating member 25 is advanced while drawing a curve in the rotating direction.

Therefore, the peeling force starts to be exerted on the leading end of the recording medium $P_b$ which passes the boundary of the line L and enters the region. The action of the peeling force is surely produced while the leading end of the recording medium is in the region partitioned between the line L and the line M. That is, the above action is exerted on the recording medium $P_c$ whose leading end is positioned in the region.

In addition, if the entire recording medium draws a curve for some time even after the recording medium passes the region, the peeling force is still exerted on the recording medium due to the action of the rigidity of the recording medium itself. That is, the above action is exerted on the recording medium $P_d$ whose leading end passes the boundary of the line M and is positioned downstream of the region.

Thereafter, the rotating member 25 is again advanced linearly in the rotating direction, and the action of the peeling force due to the rigidity of the recording medium is not exerted on the recording medium $P_e$ that is in close contact with the rotating member 25 at that position.

In the recording medium shown in FIG. 13, the recording medium between $P_b$ and $P_d$ can be peeled off, and the subject matter of the present invention resides in that the entire surface of the recording medium is peeled off by using the peeling force due to the rigidity of the recording medium (the second aspect of the present invention), or by supplementing the peeling force and effectively peeling off only the leading end (the first aspect of the present invention). From this viewpoint, it is required that the recording medium is peeled off when it is between $P_b$ and $P_d$, that is, when the leading end of the recording medium is positioned in the region between the line L and the line M where the surface of the rotating member is advanced while drawing a curve in the rotating direction, or is positioned downstream of that region.

When a distance between one side (leading end) of the peeling guide plate which is close to the surface of the rotating member and the surface of the rotating member is made shorter, the leading end of the peeling guide plate can be arranged almost on the line L. When the distance is made longer, the leading end of the peeling guide plate can be arranged extremely downstream of the line M. Accordingly, as described above, it is necessary that a position at which the peeling guide plate is mounted is set to a region in which the surface of the rotating member is advanced while drawing a curve in the rotating direction, or downstream of the region. In this specification, a specific range of "downstream of the region" is not generally defined because it depends on the rigidity of the recording medium due to its thickness or material, the region of the toner image, the amount of toner of the toner image, or the like.

In the above-mentioned example, the position of the peeling guide plate becomes a matter to be considered only when the rotating member to be peeled off is a belt, and in the case where the rotating member is cylindrical as in the above-mentioned respective embodiments, because the surface of the rotating member always draws a curve in the rotating direction, and the action of the peeling force occurs at any position, the requirement related to the position of the peeling guide plate is not a matter to be considered. How to consider the position of the peeling guide plate is not limited to a case in which the peeling device according to the present invention is applied to the fixing device, but is applied to a case in which the peeling device is applied to any position of an image forming apparatus as in, for example, an image forming apparatus which will be described later.

The fixing device thus structured can be applied to a conventional image forming apparatus of the electrophotographic process. That is, in an image forming apparatus having a toner image forming unit for forming an unfixed toner image on the surface of a sheet-like recording medium through the electrophotographic process, and a fixing unit for fixing the toner image retained on the surface of the recording medium by heating and pressurizing the toner image, the fixing device structured as described above is used as the fixing unit, thereby being capable of providing an image forming apparatus which is excellent in the peeling property, and can satisfy the high image quality and the high processing speed.

The above-mentioned toner image forming unit may include, for example, an electrostatic image forming unit for forming an electrostatic latent image on an electrostatic latent image carrier, a developing unit for developing the electrostatic latent image by toner, and a transferring unit for transferring the obtained toner image to a sheet-like recording medium.

As the structure other than the fixing device, any well-known structure can be employed as long as the structure is not away from the object of the present invention. In addition, it is needless to say that the peeling device according to the present invention is applied to the structural element other than the fixing device.

Embodiment 4

Figure 14:
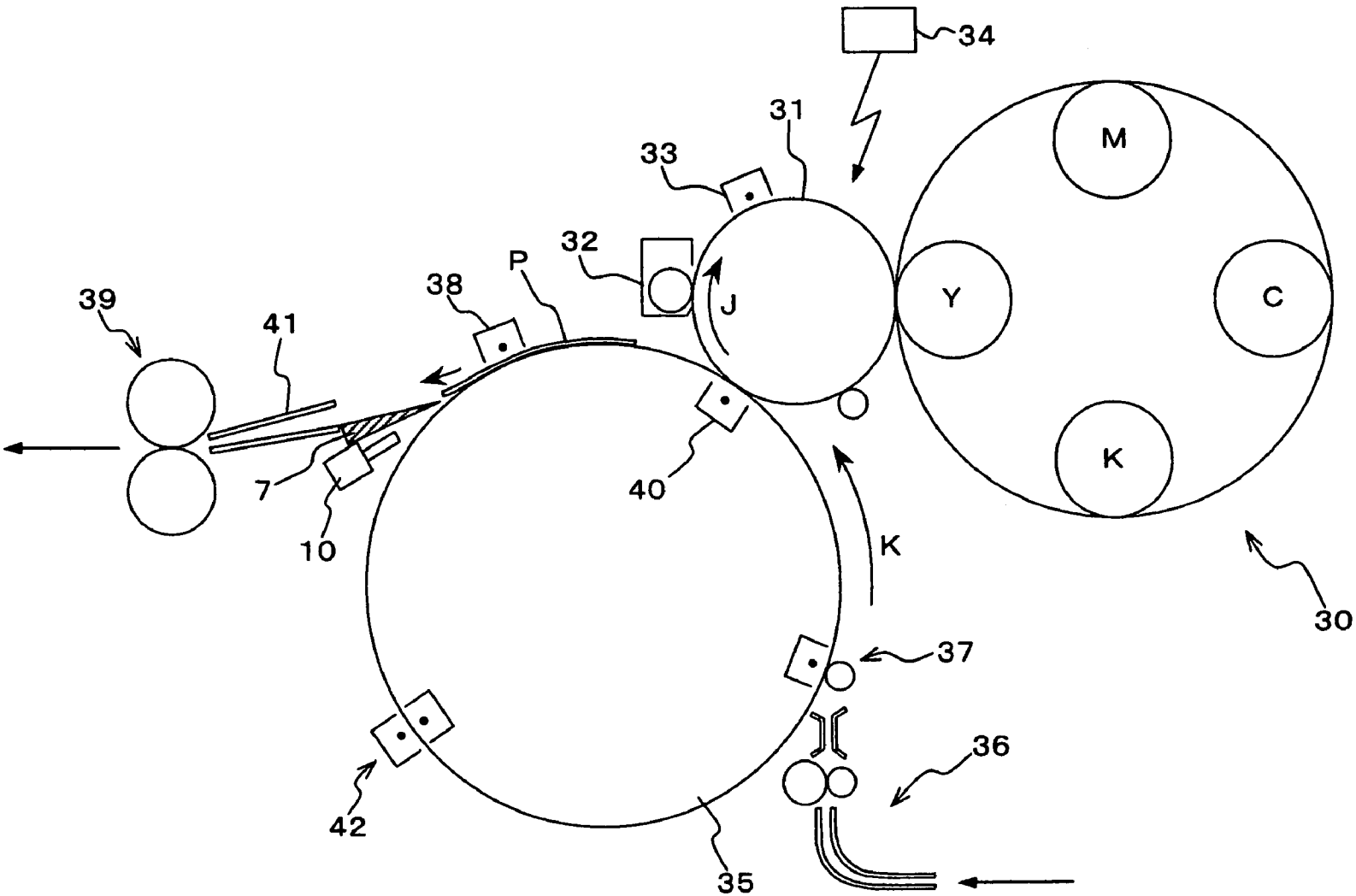
FIG. 14 is a schematic cross-sectional view showing a fixing device in accordance with Embodiment 4 of the present invention to which the peeling device used in Embodiment 1 of the present invention is applied.

FIG. 14 is a schematic cross-sectional view showing an example of an image forming apparatus to which the peeling device according to the first aspect of the present invention is applied as a unit for peeling a transfer medium from a transfer drum, in accordance with Embodiment 4. The peeling device according to this embodiment is the combination of the first aspect of the present invention and the second aspect of the present invention as in Embodiment 1.

The image forming apparatus according to this embodiment is made up of a photosensitive member 31 that rotates in a direction indicated by an arrow J, and other components arranged around the photosensitive member 31 in the rotating direction J in the following order: a charging device 33 that uniformly charges the photosensitive member 31, an exposing device 34 that exposes the surface of the photosensitive member 31 into an image, a rotary developing device 30 that forms the toner images of the respective colors consisting of yellow (Y), magenta (M), cyan (C) and black (K) on the surface of the photosensitive member 31, respectively, a transfer drum 35 that electrostatically carries and conveys the sheet (recording medium) P in a direction indicated by an arrow K to transfer the toner image formed on the photosensitive member 31 onto the surface of the sheet P, a cleaning device 32 that removes the toner or the like remaining on the surface of the photosensitive member 31, peeling devices 7 and 10 for peeling the sheet P onto the surface of which the toner image has been transferred, and a fixing device 39 that fixes the sheet P by heat and pressure to form a recorded image.

In the image forming apparatus according to this embodiment, an image exposure is conducted by the exposing device 34 such that a latent image of only a yellow color component is formed on the surface of the photosensitive member 31 which has been uniformly charged by the charging device 33. Then, the toner image of yellow is formed on the surface of the photosensitive member 31 by the rotary developing device 30, and the photosensitive member 31 rotates in the direction indicated by the arrow J as it is to convey the toner image of yellow to a position that faces the transfer drum 35.

On the other hand, the sheet P that has been fed through a sheet feed guide 36 is given an electrostatic force by a charging device 37 and stuck onto the transfer drum 35 in close contact. In this state, when the transfer drum 35 rotates in a direction indicated by an arrow K, the sheet P is conveyed to a position that faces the photosensitive member 31. The toner image of yellow which has been formed on the surface of the photosensitive member 31 in advance is transferred onto the surface of the sheet P by a transfer device 40.

The transfer drum 35 with which the sheet P that carries the toner image of yellow on the surface thereof is in close contact rotates in the direction indicated by the arrow K to convey the sheet P to the position that faces the photosensitive member 31 again after rotating around the photosensitive member 31 once. During the conveyance, all of a peeling and discharging device 38, the peeling devices 7 and 10, a discharging device 42, and the charging device 37 do not operate, and the sheet P is conveyed while being in close contact with the transfer drum 35.

The photosensitive member 31 after completion of the transfer of the toner image of yellow rotates in the direction indicated by the arrow J, the residual toner or dust is removed from the photosensitive member 31 by the cleaning device 32, and the photosensitive member 31 is made to standby for the toner image formation of a subsequent color.

The above operation is repeated subsequently for magenta, cyan, and black. Accordingly, toner images of four colors are superimposed on the surface of the sheet P to form an unfixed full-color toner image.

The sheet P onto the surface of which a toner image of a final color (black in this example) has been transferred by the transfer device 40 is conveyed due to the rotation of the transfer drum 35 in the direction indicated by the arrow K, and is discharged by the peeling and discharging device 38. An electrostatic adhesion between the surface of the transfer drum 35 and the sheet P is weakened, and the peeling force caused by the rigidity of the sheet P itself is exerted on the leading end of the sheet P in the conveying direction.

Then, the sheet P is peeled by the peeling devices 7 and 10. The peeling is performed such that the leading end of the sheet P in the conveying direction is peeled and allowed to float by means of a compressed air from the gas jetting device 10, and is made to run onto the leading end of the peeling guide plate 7, successively peeling the sheet P to finally peel the entire surface of the sheet P. The detailed structure, action, effects, preferred modes, and so on of the peeling devices 7 and 10 have been already described in detail in Embodiment 1, and therefore will be omitted. In this embodiment, because the compressed air from the gas jetting device 10 acts on the rear surface of the sheet P (a side that is in close contact with the transfer drum 35), the possibility that the unfixed toner image formed on the front surface of the sheet P is adversely affected by the compressed air is low.

Then, the peeled sheet P is conveyed to the fixing device 39 through the conveying guide 41, and the unfixed toner image is fixed by heat and pressure to form the recorded image. On the other hand, the transfer drum 35 from which the sheet P has been peeled rotates in the direction indicated by the arrow K, and is discharged by the discharging or charge eliminating device 42, and the transfer drum 35 is made to standby for carrying a subsequent sheet.

In the above-mentioned image forming apparatus, the peeling device according to the present invention can effectively peel the sheet P that is electrostatically in close contact with the transfer drum 35 without damaging the transfer drum 35 made of a dielectric such as polytetrafluoethylene because the leading end of the peeling guide plate 7 does not abut against the transfer drum 35. Because peeling is effectively enabled, it is unnecessary to provide an auxiliary peeling unit such as a hop-up device that pushes up the transfer drum 35 from the inner surface, and the sheet P that is in close contact with the transfer drum 35 at a position where the sheet P cannot be peeled by the auxiliary peeling unit can also be satisfactorily peeled. Also, the device can be simplified by omitting the auxiliary peeling unit.

In this embodiment, as the peeling device, a description was given of the combination of both structures of the first aspect and second aspect of the present invention as in Embodiment 1. However, it is needless to say that the image forming apparatus can be preferably be provided with the peeling device having only the structure according to the first aspect of the present invention as described in Embodiment 1, and can also be preferably provided with the peeling device having only the structure according to the second aspect of the present invention as described in Embodiment 3.

The peeling device, the fixing device, and the image forming apparatus in accordance with the present invention were described with reference to several examples. However, the present invention is not limited to those structures, and can be variously modified by public knowledge by any person skilled in the art without any problem as long as any one of essential structural requirements in the first and second aspects of the present invention is provided.

EXAMPLE

Hereinafter, a description will be given in more detail of the present invention with reference to various examples. It should be noted that the present invention is not limited to the following examples.

EXAMPLE 1

The evaluation tests of the sheet peeling property and image quality have been conducted by using the fixing device structured in accordance with Embodiment 1. The evaluation was conducted under the condition where the peeling force that peels off the sheet P is large in a state where the fused toner on the surface of the sheet P after having passed through the nip portion N adheres to the fixing roll 1.

Specific parameters are stated below.

(Parameters of the Fixing Device Portion)

The structure of the fixing roll 1: Two kinds of rolls: monochrome fixing hard roll (a fluorine-resin-coated hard roll obtained by coating an aluminum core 40 mm in diameter with a PFA tube 20 μm in thickness), and a color fixing soft roll (a roll obtained by coating a cylindrical aluminum core 62 mm in outer diameter, 55 mm in inner diameter and 350 mm in length with a silicone LSR (liquid silicone rubber) rubber (the rubber hardness of JIS-A: 35 degrees) 2 mm in thickness, and forming a PFA tube 30 μm in thickness as a surface layer on the surface of an elastic layer)

The rotating speed (process speed) of the fixing roll 1: 250 mm/s

The surface temperature of the fixing roll 1: Controlled to 160° C.

A nip pressure between the fixing roll 1 and the pressure roll 6: 490 to 686 N (50–70 kgf))

Figure 15:
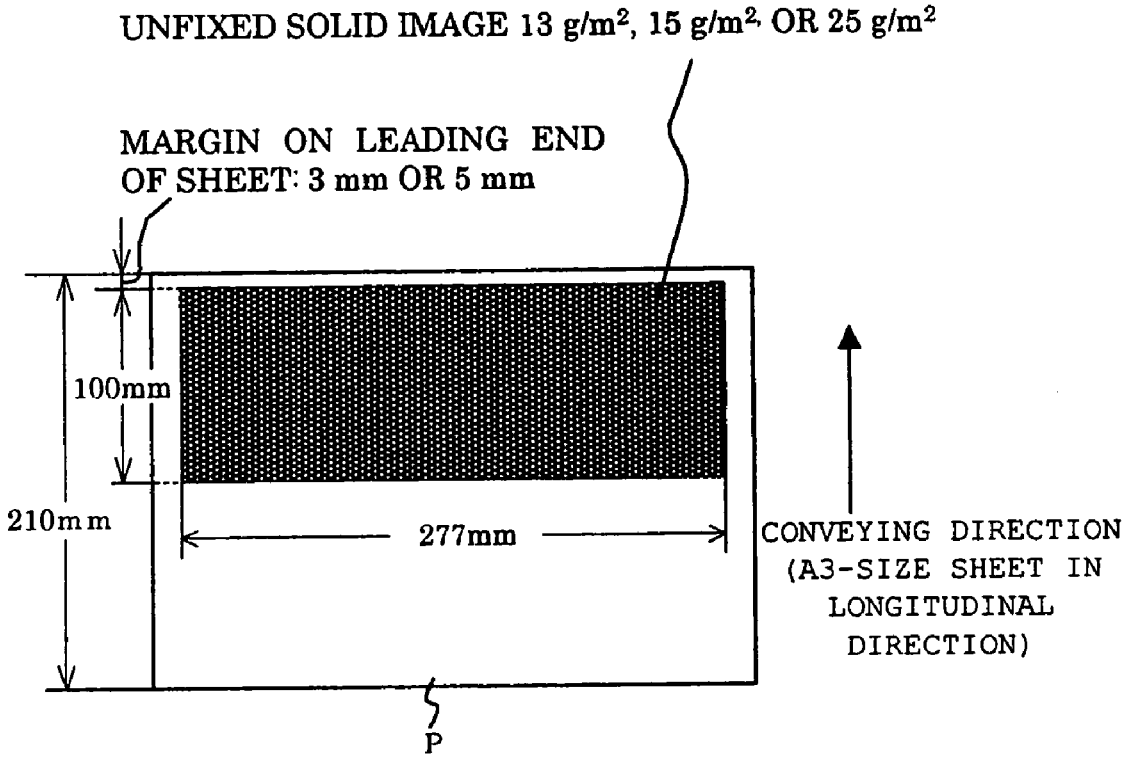
FIG. 15 is a plan view showing a sheet for explaining a state of an unfixed toner image formed in an evaluation test of the embodiment of the present invention.

A sheet P (recording medium): An A4-size S-sheet made by Fuji Xerox Corporation (a typically used plain paper 56 g/m$^2$ in basis weight), and an A4-size OK top coated paper made by Fuji Xerox Corporation (a paper 64 g/m$^2$ in basis weight which is small in the basis weight and weak in rigidity) are selected, and the conveying direction is set to long edge feed as shown in FIG. 15.

Toner: Color polymerization toner for oilless fuser (oilless color polymerization toner made by Fuji Xerox Corporation, and EA toner: The toners obtained by reacting pigment, wax particles, and emulsion polymerization resin particles that combine the pigment and the wax particles together chemically with each other in aqueous solution and molding those components by heating)

Unfixed toner image T: The image obtained by electrostatically transferring the solid image of a process black consisting of three colors, that is, yellow, magenta, and cyan over the substantially overall width of the sheet P. Each 20 sheets onto which toner images 13*g/m*$^2$ and 15 g/m$^2$ in the amount of toner (the toner image 25 g/m$^2$ in the amount of toner can be implemented only in the present invention) have been transferred are prepared according to the respective levels, and all the toner images are fixed onto the sheets. The evaluations that will be described later were conducted through the entire test using the two kinds of toner amounts. The margin on the leading end of the sheet is set to one of two levels of 3 mm and 5 mm as shown in FIG. 15. The unfixed monochrome toner image is obtained by electrostatically transferring 0.7 g/m$^2$ of solid image in unicolor black.

(Parameters of the Air Jetting Device 10)

Air pump 10*d*: A commercially available pump 8 litters/mm in air supply performance Accumulator or air holder 10*c*: An accumulator 200 cc in tank capacity The number of air nozzles: Three The diameter of an orifice of an electromagnetic valve: 1.5 mm Compressed air: Air is used, the pressure and jet time being set to 0.3 Mpa and 0.025 sec, respectively.

Jet timing of the compressed air: The jet test of the compressed air is conducted in advance to set an appropriate state.

(Parameters of the Peeling Guide Plate 7)

There is adopted the peeling guide plate 7 having a deformed leading end shape that includes three convex portions and is adjusted to the length of the A-4 width as shown in FIGS. 4(*a*) and 4(*b*). Specific dimensions are 392 mm in longitudinal length, 32 mm in the length of sides 8*a* and 8*b* and 5 mm in the length of a side 8*c* in FIG. 4(*b*), 36 mm in the width of the convex portion 7*a*, about 50 mm in the radius of curvature of the concave portion 7*b* at the side of the surface 8*a*, and 60 mm in the radius of curvature of the concave portion 7*b* at the side of the rear surface 8*b*.

Material of the Peeling Guide Plate 7: Stainless Steel

An angle θ formed between the surface 8*a* and a tangent E to the surface of the fixing roll 1 at a peeling point S (refer to FIG. 8): 5°

A gap between the leading end of the peeling guide plate 7 and the surface of the fixing roll 1: 0.3 mm The located position of the peeling guide plate 7: Adjusted appropriately (4 to 15 mm from the outlet of the nip portion N)

The fixing device that satisfies the above-mentioned conditions (including the peeling device) was used, the fixing operation was conducted at eight levels consisting of two kinds of sheets P, two kinds of fixing rolls 1, and two levels of margins of the leading end of the sheet P, and the evaluation test of the peeling property was conducted. In the evaluation test, after 20 sheets P onto which the unfixed toner image T had been electrostatically transferred were continuously allowed to pass through the nip portion of the fixing device, and it was examined whether or not the sheets P can be peeled off smoothly and stably without jamming the sheets P. The evaluation items were the peeling performance of the sheet P, and the image quality of the obtained image, which were evaluated on the basis of the following standard. The results are shown in Table 1 below.

(Peeling Performance)
O: excellent
Δ: Jamming may occur
X: Jamming occurs (Image Quality)
O: No defect is ever found even by gaze.
Δ: A micro-defect is found by gaze.
X: A defect visually found may occur.

COMPARATIVE EXAMPLE 1

The peeling devices 7 and 10 were removed from the fixing device shown in Example 1. Instead, the peeling claw (A conventionally used peeling claw resulting from molding a heat-resistant resin such as polyimide or polyphenylene sulphite and furnishing its leading end into a sharp configuration. The peeling claw of this type is so located as to be pushed against the surface of the fixing roll 1 by using a spring. The width of an edge of the peeling claw which is in contact with the surface of the fixing roll is set to about 2 mm, and five or six peeling claws narrow in the width are arranged in the axial direction of the fixing roll.) was attached so as to be abutted against the surface of the fixing roll 1, and the same evaluation test as that in Example 1 was conducted. The results are indicated in Table 1 below.

COMPARATIVE EXAMPLE 2

The peeling devices 7 and 10 were removed from the fixing device shown in Example 1. Instead, a plastic peeling sheet (The conventionally used peeling sheet is a plastic sheet that is 0.05 mm or more in thickness, $10^3$ kg/cm$^2$ or more in flexural modulus and 150° C. or higher in fusing point, and is disposed such that the sharp edge thereof comes in uniform contact with the entire surface of the fixing roll in the axial direction (disclosed in JP 59-188681 A).) was attached so as to be abutted against the surface of the fixing roll, and the same evaluation test as that in Example 1 was conducted. The results are indicated in Table 1 below.

TABLE 1

| Sheet P | Toner | Fixing roll 1 | Margin of leading end of sheet (mm) | Comparative Example 1 (Peeling claw) Peeling performance | Comparative Example 1 (Peeling claw) Image quality | Comparative Example 2 (Plastic peeling sheet) Peeling performance | Comparative Example 2 (Plastic peeling sheet) Image quality | Example 1 Peeling performance | Example 1 Image quality |
|---|---|---|---|---|---|---|---|---|---|
| S-sheet made by Fuji Xerox Corporation | Oilless color polymerization toner | Monochrome fixing hard roll | 5 | □ | □ | □ | □ | □ | □ |
| | | | 3 | x | — | □ | □ | □ | □ |
| | | Color fixing soft roll | 5 | □ | □ | □ | □ | □ | □ |
| | | | 3 | x | — | x | — | □ | □ |
| OK top coated paper made by Fuji Xerox Corporation | Oilless color polymerization toner | Monochrome fixing hard roll | 5 | □ | □ | □ | □ | □ | □ |
| | | | 3 | x | — | x | — | □ | □ |
| | | Color fixing soft roll | 5 | □ | x | x | — | □ | □ |
| | | | 3 | x | — | x | — | □ | □ |

CONSIDERATION OF EXAMPLE 1 AND COMPARATIVE EXAMPLES 1 AND 2

As shown in Table 1, in the peeling system of Comparative Examples 1 and 2, in the case where the fixing roll 1 is a monochrome fixing hard roll, the sheet peeling property can be finally ensured, and the excellent image quality can be achieved. However, in the case where the fixing roll 1 is a color fixing soft roll, all the sheets are jammed, and the image per se cannot be obtained under the condition where the margin of the leading end of the sheet P is 3 mm in which the sheet performance is not sufficient, jamming is liable to occur, and particularly the toner image is formed up to the vicinity of the leading end of the sheet P in the conveying direction.

On the contrary, in Example 1 using the peeling device that employs the compressed air according to the present invention, it is found that the excellent peeling performance is exhibited, no jamming occurs, and the recorded image of the excellent image quality can be obtained. In addition, in the present invention, the test was implemented under the condition where the amount of toner of the unfixed toner image was 25 g/m$^2$. As a result, an excellent peeling performance is exhibited even under the condition where the amount of toner is extremely excessive, and it can be confirmed that the higher effect of the present invention can be obtained.

EXAMPLE 2

In this example, an OK top coated paper made by Fuji Xerox Corporation used in Example 1 is allowed to absorb moisture in a state of 90% in humidity for 24 hours or longer and used as the sheet P. This is because a paper small in the basis weight and weak in rigidity and a paper whose surface property is smooth (for example, a coated paper) are more difficult to peel off, and it is naturally difficult to peel off the sheet. Further, it is more difficult to peel off the paper in a state where the paper absorbs moisture. That is, in this example, examination is conducted under the hardest conditions for peeling off the sheet.

In the moisture absorption of the paper, in order to provide the conditions under which the paper absorbs a large amount of moisture in the atmosphere such that an issue such as jamming is liable to occur in actual use, a high-moisture condition is given for a given period of time to provide a moisture-absorbed paper that serves for the test.

In addition, under the circumstances where the following respective conditions were varied, and other conditions were identical with those in Example 1, the evaluation test of fixing was conducted.

Sheet P (recording medium): Only an OK top coated paper made by Fuji Xerox Corporation (a paper 64 g/m$^2$ in basis weight which is small in basis weight and weak in rigidity)

The amount of toner of the unfixed toner image T: Only 15 g/m$^2$

The margin of the sheet leading end: Only 3 mm

The rotating speed (process speed) of the fixing roll 1: Appropriately changed between 100 and 350 mm/s (as shown in Table 2 below)

Compressed air: An air is used, the compressed air being appropriately changed at a pressure of 0.05 to 0.55 MPa for the jet time 0.01 to 0.05 sec (as shown in Table 2 below)

The gap between the leading end of the peeling guide plate 7 and the surface of the fixing roll 1: Changed between 0.1 and 1.0 mm The results are shown in Table 2 below. In Table 2, when a value to be changed is represented by a range (using "-"), it represents that the value is changed arbitrarily at non-steps within that range. Also, the peeling performance was classified into the peeling property of the leading end of the sheet P due to the compressed air and the subsequent peeling property of the entire surface of the sheet P due to the peeling guide plate to conduct the evaluation. The standard of the evaluation is identical with that in Example 1.

CONSIDERATION OF EXAMPLE 2

As shown in Table 2, in Example 2 using the peeling device that employs the compressed air in accordance with the present invention, it is found that the excellent peeling performance is exhibited, and the recording image excellent in the image quality can be obtained even under the above worst conditions. However, when the pressure of the compressed air is too high or too low, the image quality and the peeling property due to the peeling guide plate are slightly deteriorated, and it is found that in this example, the range of 0.1 to 0.3 MPa is optimum. From the viewpoint of making the speed higher, the test was conducted at a process speed of 200 mm/sec or higher as a rule. However, because the air pump 10*d* must be large-sized at 0.5 MPa, the test was conducted only at 200 m/sec or lower. From this view point, it is also found that when the pressure of the compressed air is too high, the device is large-sized and the costs become high.

EXAMPLE 3

The fixing operation and the peeling operation were conducted under the same conditions of the fixing device (including the peeling device) as those in Example 1 except that the rubber hardness of a silicone LSR (liquid silicone rubber) rubber which is an elastic layer of the fixing roll was changed to 25 degrees in Example 1, and the evaluation test of the peeling performance and the image quality were conducted. As the sheet P, the same moisture-absorbed OK top coated paper made by Fuji Xerox Corporation as that used in Example 2 was tested. The results are shown in Table 3 below.

EXAMPLE 4

The fixing operation and the peeling operation were conducted under the same conditions of the fixing device

TABLE 2

| Conditions of sheet P, toner image T, etc. | Toner | Fixing roll 1 | Conveying speed of sheet P (mm/sec) | Pressure of the compressed air (MPa) | Jet time of compressed air (sec) | Gap between peeling guide plate 7 and fixing roll 1 (mm) | Peeling performance: Due to compressed air | Peeling performance: Due to peeling guide plate | Image quality |
|---|---|---|---|---|---|---|---|---|---|
| OK top coated sheet made by Fuji Xerox Corporation which is allowed to absorb moisture with sheet size (A3), amount of toner (15 g/m$^2$), and margin of leading end of sheet P (3 mm) | Oilless color polymerization toner | Monochrome fixing hard roll and color fixing soft roll | 100 to 200 | 0.55 | 0.01 to 0.05 | 0.1 to 1.0 | ◎ | ◎ | □ |
| | | | 100 to 200 | 0.5 | 0.01 to 0.05 | 0.1 to 1.0 | ◎ | ◎ | □ |
| | | | 200 to 350 | 0.3 | 0.01 to 0.05 | 0.1 to 1.0 | ◎ | ◎ | ◎ |
| | | | 200 to 350 | 0.1 | 0.01 to 0.05 | 0.1 to 1.0 | ◎ | ◎ | ◎ |
| | | | 200 to 350 | 0.05 | 0.01 to 0.05 | 0.1 to 1.0 | ◎ | □ | □ |

(including the peeling device) as those in Example 3 except that the air jetting device 10 did not operate such that the compressed air was not jetted in Example 3, and the evaluation test of the peeling performance and the image quality were conducted. The results are shown in Table 3 below.

EXAMPLE 5

The fixing operation and the peeling operation were conducted under the same conditions of the fixing device (including the peeling device) as those in Example 3 except that the configuration of the peeling guide plate 7 was changed such that the concave portions 7*b* were projected from the configuration shown in FIGS. 4(*a*) and 4(*b*) and aligned with the convex portions 7*a* at the leading end, and the leading end is linear (the cross-section in the longitudinal direction becomes an acute-angled triangle having formed by sides 8*a*, 8*b*, and 8*c* shown in FIG. 4(*b*)) in Example 3, and the evaluation test of the peeling performance and the image quality were conducted. The results are shown in Table 3 below.

COMPARATIVE EXAMPLE 3

The fixing operation and the peeling operation were conducted using the fixing device according to Comparative Example 1 attached with the peeling claw under the same conditions of the fixing device (including the peeling device) as those in Example 3, and the evaluation test of the peeling performance and the image quality was conducted. The results are shown in Table 3 below.

COMPARATIVE EXAMPLE 4

The fixing operation and the peeling operation were conducted using the fixing device according to Comparative Example 2 attached with the plastic peeling sheet under the same conditions of the fixing device (including the peeling device) as those in Example 3, and the evaluation test of the peeling performance and the image quality was conducted. The results are shown in Table 3 below.

TABLE 3

| | | | Margin of leading end of | Example 3 (Compressed air + peeling guide plate of deformed leading end shape) | | Example 4 (Only peeling guide plate of deformed leading end shape) | | Example 5 (Compressed air + peeling guide plate having a linear leading end) | |
|---|---|---|---|---|---|---|---|---|---|
| Sheet P | Toner | Fixing roll 1 | sheet (mm) | Peeling performance | Image quality | Peeling performance | Image quality | Peeling performance | Image quality |
| S-sheet made by Fuji Xerox Corporation | Oilless color polymerization toner | Monochrome fixing hard roll | 5 | □ | □ | □ | □ | □ | □ |
| | | | 3 | □ | □ | □ | □ | □ | □ |
| | | Color fixing soft roll | 5 | □ | □ | □ | □ | □ | □ |
| | | | 3 | □ | □ | □ | □ | □ | □ |
| OK top coated paper made by Fuji Xerox Corporation | | Monochrome fixing hard roll | 5 | □ | □ | □ | □ | □ | □ |
| | | | 3 | □ | □ | □ | □ | □ | □ |
| | | Color fixing soft roll | 5 | □ | □ | □ | □ | □ | □ |
| | | | 3 | □ | □ | x | — | □ | □ |
| OK top coated sheet made by Fuji Xerox Corporation which is allowed to absorb moisture | | Monochrome fixing hard roll | 5 | □ | □ | □ | □ | □ | □ |
| | | | 3 | □ | □ | □ | □ | □ | □ |
| | | Color fixing soft roll | 5 | □ | □ | □ | □ | □ | □ |
| | | | 3 | □ | □ | x | — | □ | □ |

| | | | Margin of leading end of | Comparative Example 3 (Peeling claw) | | Comparative Example 4 (Plastic peeling sheet) | |
|---|---|---|---|---|---|---|---|
| Sheet P | Toner | Fixing roll 1 | sheet (mm) | Peeling performance | Image quality | Peeling performance | Image quality |
| S-sheet made by Fuji Xerox Corporation | Oilless color polymerization toner | Monochrome fixing hard roll | 5 | □ | □ | □ | □ |
| | | | 3 | □ | □ | □ | □ |
| | | Color fixing soft roll | 5 | □ | x | □ | □ |
| | | | 3 | □ | x | □ | □ |
| OK top coated paper made by Fuji Xerox Corporation | | Monochrome fixing hard roll | 5 | □ | □ | □ | □ |
| | | | 3 | □ | □ | □ | □ |
| | | Color fixing soft roll | 5 | □ | x | x | — |
| | | | 3 | □ | x | x | — |

TABLE 3-continued

| | | | | | | |
|---|---|---|---|---|---|---|
| OK top coated sheet made by Fuji Xerox Corporation which is allowed to absorb moisture | Monochrome fixing hard roll | 5 | □ | □ | □ | □ |
| | | 3 | □ | □ | □ | □ |
| | Color fixing soft roll | 5 | □ | x | x | — |
| | | 3 | □ | x | x | — |

CONSIDERATION OF EXAMPLES 3 TO 5 AND COMPARATIVE EXAMPLES 3 TO 4

As shown in Table 3, in the peeling system of Comparative Examples 3 and 4, in the case where the fixing roll 1 is a monochrome fixing hard roll, the sheet peeling property can be finally ensured, and the excellent image quality can be achieved. However, in the case where the fixing roll 1 is a color fixing soft roll, all the sheets are jammed, and the image per se cannot be obtained under the condition where the margin of the leading end of the sheet P is 3 mm in which the sheet performance is not sufficient, jamming is liable to occur, and particularly the toner image is formed up to the vicinity of the leading end of the sheet P in the conveying direction.

On the contrary, in Examples 3 to 5 using the peeling device with either or both structures of the first aspect of the present invention utilizing the compressed air and the second aspect of the present invention utilizing the peeling guide member having the deformed leading end shape, it is found that the excellent peeling performance is exhibited, no jamming occurs, and the recorded image of the excellent image quality can be obtained. Except for the particularly hard conditions that the fixing roll 1 is the color fixing soft roll and oilless (using no releasing oil), the toner image is formed up to the vicinity of the leading end of the sheet P in the conveying direction, the amount of toner is extremely excessive, the sheet P is a coated paper or a moisture-absorbed paper, or the like, even in the fixing device (including the peeling device) of Example 4 having only the second aspect of the present invention utilizing the peeling guide member having the deformed leading end shape, or the fixing device (including the peeling device) of Example 5 having only the structure of the first aspect of the present invention utilizing the compressed air, the excellent peeling performance and the recorded image of the excellent image quality can be realized. In the particularly hard conditions, it is found that Example 3 using the peeling device having both structures of the first aspect of the present invention and the second aspect of the present invention is extremely advantageous.

As described above, according to the present invention, even in the conditions under which peeling is difficult in the conventional fixing device using the peeling claw or the peeling sheet (for example, the amount of toner of the toner image is large, the toner image exists up to the vicinity of the leading end of the recording medium, the basis weight of the recording medium is small, the recording medium is a thin coated paper, the releasing oil is not used, or the like), there can be provided the peeling device that can conduct the stable peeling operation without damaging the image, the recording medium, and the rotating member including the fixing roll, the fixing device using the peeling device, and the fixing device and the image forming apparatus which are provided with the peeling device. More particularly, the peeling device according to the present invention enables the stable peeling of the recording medium, and can be extremely preferably applied to an oilless color fixing device of the high productivity.

What is claimed is:

1. A peeling device for peeling off a sheet-like recording medium that is conveyed while adhering to a surface of a rotating member that rotates, from the rotating member, comprising:

a peeling guide plate one side of which is close to a surface of the rotating member in a region where the surface of the rotating member advances while curving in the rotating direction, or on a downstream side of the region and which is disposed in a rotating direction of the rotating member, and an edge surface of the peeling guide plate including at least one convex portion; and an air jetting unit that jets a pulsed compressed air toward a gap between the surface of the rotating member and the one side of the peeling guide plate that is from a region interposed between the surface of the rotating member and the surface of the peeling guide plate that faces the surface of the rotating member.

2. A peeling device according to claim 1, wherein the compressed air is jetted by the air jetting unit so that the compressed air is blown to a leading end when the leading end of the recording medium in a conveying direction which is conveyed in accordance with a rotation of the rotating member is close to a position at which the peeling guide plate is disposed.

3. A peeling device according to claim 2, wherein the air jetting unit is controlled so as to jet only the compressed air in an amount sufficient for the leading end of the recording medium in the conveying direction which is peeled off from the surface of the rotating member due to the compressed air to run onto the one side of the peeling guide plate which is close to the surface of the rotating member, and a portion subsequent to the leading end of the recording medium in the conveying direction successively runs on the one side of the peeling guide plate which is close to the surface of the rotating member while the recording medium is conveyed in accordance with the rotation of the rotating member, and the surface of the recording medium is rubbed and moved on a rear side of the surface of the peeling guide plate which faces the surface of the rotating member so that the recording medium is successively peeled off from the surface of the rotating member, and an entire surface of the recording medium is finally peeled off from the recording medium.

4. A peeling device according to claim 1, wherein the air jetting unit has a nozzle that jets the compressed air, disposed in the region interposed between the surface of the rotating member and the surface of the peeling guide plate that faces the rotating member.

5. A peeling device according to claim 4, wherein plural nozzles are disposed in a direction perpendicular to the rotating direction of the rotating member.

6. A peeling device according to claim 4, wherein a portion of the one side of the peeling guide plate which is close to the surface of the rotating member, which faces a center of an advancing direction of the compressed air which is jetted by each of the nozzles and vicinities thereof project toward the surface of the rotating member.

7. A fixing device which has at least a heat rotating member that rotates while a surface of the heat rotating member is heated, and a pressure rotating member which is abutted against the surface of the heat rotating member to form a nip portion, and in which a sheet-like recording medium whose surface has a toner image formed thereon with an unfixed toner passes through the nip portion so that the surface on which the toner image is formed is abutted against the surface of the heat rotating member to fix the toner image, the fixing device comprising:

a peeling device that peels off the recording medium that is conveyed while adhering to the surface of the heat rotating member due to the fused toner which forms the toner image after passing through the nip portion from the heat rotating member, the peeling device comprising the peeling device according to claim 1.

8. A fixing device according to claim 7, wherein the heat rotating member is formed in a roll shape or an endless belt shape.

9. A fixing device according to claim 7, wherein the pressure rotating member is formed in a roll shape or an endless belt shape.

10. An image forming apparatus, comprising:

a toner image forming unit that forms an unfixed toner image on a surface of a sheet-like recording medium through an electrophotographic process; and a fixing unit that fixes the toner image retained on the surface of the recording medium by heating and pressurizing, the fixing unit comprising the fixing device according to claim 7.

* * * * *